US010909825B2

(12) United States Patent
Scalisi

(10) Patent No.: US 10,909,825 B2
(45) Date of Patent: Feb. 2, 2021

(54) OUTDOOR SECURITY SYSTEMS AND METHODS

(71) Applicant: SkyBell Technologies, Inc., Irvine, CA (US)

(72) Inventor: Joseph Frank Scalisi, Yorba Linda, CA (US)

(73) Assignee: SkyBell Technologies IP, LLC, Irvine, CA (US)

( * ) Notice: Subject to any disclaimer, the term of this patent is extended or adjusted under 35 U.S.C. 154(b) by 0 days.

(21) Appl. No.: 16/734,221

(22) Filed: Jan. 3, 2020

(65) Prior Publication Data

US 2020/0143644 A1 May 7, 2020

Related U.S. Application Data

(63) Continuation-in-part of application No. 16/055,155, filed on Aug. 5, 2018.
(Continued)

(51) Int. Cl.
*G08B 13/196* (2006.01)
*G08B 5/38* (2006.01)
(Continued)

(52) U.S. Cl.
CPC ..... *G08B 13/19628* (2013.01); *G08B 5/38* (2013.01); *G08B 13/1966* (2013.01);
(Continued)

(58) Field of Classification Search
CPC ..... G08B 13/19628; G08B 5/38; G08B 13/19619; G08B 13/1966;
(Continued)

(56) References Cited

U.S. PATENT DOCUMENTS 1,647,558 A 11/1927 Best
1,647,708 A 11/1927 Monica
(Continued)

FOREIGN PATENT DOCUMENTS

CN 1902609 B 5/2010
CN 202872976 U 4/2013
(Continued)

OTHER PUBLICATIONS

Craig & Comapny—Home Tech: Doorbot—Downloaded on Nov. 18, 2013 from http://www.craigncompany.com/home-tech-doorbot/; prior art publication at least as of Jun. 10, 2013.
(Continued)

*Primary Examiner* — Twyler L Haskins
*Assistant Examiner* — Fayez Bhuiyan

(57) ABSTRACT

The disclosure includes a security system including an outdoor security device. In some embodiments, the outdoor security device comprises a housing, a light coupled to the housing and located within a hollow inner portion of the housing, and a camera and a lens coupled to the housing. In some embodiments, the security device comprises at least one directional microphone communicatively coupled to the camera and configured to determine a location of a detected sound whereby the camera performs a frame lock to capture an image associated with the detected sound.

27 Claims, 33 Drawing Sheets

Related U.S. Application Data

(60) Provisional application No. 62/560,118, filed on Sep. 18, 2017.

(51) Int. Cl.
*H04R 1/02* (2006.01)
*H04R 1/08* (2006.01)

(52) U.S. Cl.
CPC . *G08B 13/19619* (2013.01); *G08B 13/19663* (2013.01); *G08B 13/19684* (2013.01); *G08B 13/19695* (2013.01); *H04R 1/025* (2013.01); *H04R 1/08* (2013.01)

(58) Field of Classification Search
CPC ..... G08B 13/19663; G08B 13/19684; G08B 13/19695; H04R 1/025; H04R 1/08
See application file for complete search history.

(56) References Cited

U.S. PATENT DOCUMENTS 3,240,113 A 3/1966 Stechemesser
3,708,742 A 1/1973 Gunn
4,523,193 A 6/1985 Levinson
D283,130 S 3/1986 Boenning
D297,222 S 8/1988 Rauch
4,843,461 A 6/1989 Tatsumi
4,982,092 A 1/1991 Jehle
5,210,520 A 5/1993 Housley
5,428,388 A 6/1995 Von Bauer
5,493,618 A 2/1996 Stevens
5,521,578 A 5/1996 Delvalle
D371,086 S 6/1996 Collins
5,602,580 A 2/1997 Tseng
D381,638 S 7/1997 Kruse
5,774,569 A 6/1998 Waldenmaier
5,781,108 A 7/1998 Jacob
5,784,446 A 7/1998 Stuart
D404,673 S 1/1999 Gordon
5,907,352 A 5/1999 Gilley
5,995,139 A 11/1999 Lee
6,028,626 A 2/2000 Aviv
D421,727 S 3/2000 Pierson
D422,521 S 4/2000 Morrow
6,073,192 A 6/2000 Clapp
6,094,213 A 7/2000 Mun
6,185,294 B1 2/2001 Chornenky
6,226,031 B1 5/2001 Barraclough
6,313,743 B1 11/2001 Abraham-Fuchs
6,375,366 B1 4/2002 Kato
6,429,893 B1 8/2002 Xin
6,535,243 B1 3/2003 Tullis
6,542,078 B2 4/2003 Script
6,590,604 B1 7/2003 Tucker
6,661,340 B1 12/2003 Saylor
6,727,811 B1 4/2004 Fendis
6,753,899 B2 6/2004 Lapalme
6,778,084 B2 8/2004 Chang
6,812,970 B1 11/2004 McBride
6,828,909 B2 12/2004 Script
D500,751 S 1/2005 Yukikado
D501,652 S 2/2005 Pierson
6,870,488 B1 3/2005 Compton
6,928,461 B2 8/2005 Tuli
6,930,599 B2 8/2005 Naidoo
6,993,123 B1 1/2006 Allen
7,015,943 B2 3/2006 Chiang
D519,100 S 4/2006 Shioya
D522,490 S 6/2006 Yukikado
D525,963 S 8/2006 Yukikado
7,113,578 B2 9/2006 Unger
D531,160 S 10/2006 Yukikado
7,154,531 B2 12/2006 Laird
7,193,644 B2 3/2007 Carter
D562,306 S 2/2008 Jeong
7,330,112 B1 2/2008 Emigh
7,330,649 B2 2/2008 Finizio
7,375,492 B2 5/2008 Calhoon
D577,301 S 9/2008 Johnson
7,429,924 B2 9/2008 Langer
7,440,025 B2 10/2008 Cheng
7,477,134 B2 1/2009 Langer
7,492,303 B1 2/2009 Levitan
D588,574 S 3/2009 Takahata
7,526,102 B2 4/2009 Ozer
D595,260 S 6/2009 Takahata
7,583,191 B2 9/2009 Zinser
7,701,171 B2 4/2010 Defant
7,738,917 B2 6/2010 Ryley
7,746,223 B2 6/2010 Howarter
7,751,285 B1 7/2010 Cain
7,752,070 B2 7/2010 Hatcher
7,809,966 B2 10/2010 Imao
7,826,729 B2 11/2010 Cullen
7,956,576 B2 6/2011 Neu
7,991,381 B1 8/2011 Dunne
7,991,575 B2 8/2011 Vogel
8,016,676 B2 9/2011 Carter
8,125,329 B1 2/2012 Hirou
8,139,098 B2 3/2012 Carter
8,144,183 B2 3/2012 Carter
8,144,184 B2 3/2012 Carter
8,154,581 B2 4/2012 Carter
8,164,614 B2 4/2012 Carter
D660,819 S 5/2012 Chen
8,193,919 B2 6/2012 Langer
8,224,311 B2 7/2012 Majmundar
8,237,574 B2 8/2012 Anderson
8,334,656 B2 12/2012 Weiss
8,354,914 B2 1/2013 Buckingham
8,504,103 B2 8/2013 Ficquette
D689,828 S 9/2013 Pierson
8,562,158 B2 10/2013 Chien
8,565,399 B2 10/2013 Siminoff
D692,847 S 11/2013 Barley
8,630,452 B2 1/2014 Mardirossian
8,665,333 B1 3/2014 Sharma
8,669,876 B2 3/2014 Anderson
D707,147 S 6/2014 Crippa
8,780,201 B1 7/2014 Scalisi
D710,727 S 8/2014 Siminoff
D710,728 S 8/2014 Siminoff
D711,275 S 8/2014 Scalisi
8,823,795 B1 9/2014 Scalisi
8,842,180 B1 9/2014 Kasmir
8,866,598 B2 10/2014 Collins
8,872,915 B1 10/2014 Scalisi
8,875,208 B1 10/2014 Abkairov
8,937,659 B1 1/2015 Scalisi
8,941,736 B1 1/2015 Scalisi
8,947,530 B1 2/2015 Scalisi
8,953,040 B1 2/2015 Scalisi
8,976,244 B2 3/2015 Felt
9,013,575 B2 4/2015 Scalisi
9,021,134 B1 4/2015 Patel
9,049,352 B2 6/2015 Scalisi
9,053,622 B2 6/2015 Scalisi
9,055,202 B1 6/2015 Scalisi
9,057,210 B2 6/2015 Dumas
9,058,738 B1 6/2015 Scalisi
9,060,103 B2 6/2015 Scalisi
9,060,104 B2 6/2015 Scalisi
9,065,987 B2 6/2015 Kasmir
9,113,051 B1 * 8/2015 Scalisi ..... H04N 7/185
9,142,214 B2 9/2015 Scalisi
9,172,922 B1 10/2015 Kasmir
9,196,104 B2 11/2015 Dumas
9,218,696 B2 12/2015 Dumas
9,230,424 B1 1/2016 Scalisi
9,282,665 B1 3/2016 Ladanyi
9,336,637 B2 5/2016 Neil
9,584,775 B2 2/2017 Siminoff
9,615,199 B1 4/2017 Haney
D788,061 S 5/2017 Siminoff

(56) References Cited

U.S. PATENT DOCUMENTS

D789,404 S 6/2017 Modestine
D789,820 S 6/2017 Siminoff
9,674,433 B1 6/2017 De La Cruz
D791,165 S 7/2017 Modestine
D791,240 S 7/2017 Lemberger
D791,241 S 7/2017 Lemberger
D791,243 S 7/2017 Loew
D791,878 S 7/2017 Loew
9,734,675 B2 8/2017 Siminoff
D798,177 S 9/2017 Siminoff
9,761,092 B2 9/2017 Chen
9,810,887 B1 11/2017 Abdala
9,978,260 B2 5/2018 Lee
2001/0010555 A1 8/2001 Driscoll
2001/0022627 A1 9/2001 Bernhardt
2002/0097161 A1 7/2002 Deeds
2003/0025599 A1 2/2003 Monroe
2003/0081952 A1 5/2003 Geng
2004/0085205 A1 5/2004 Yen
2004/0085449 A1 5/2004 Millet
2004/0086093 A1 5/2004 Schranz
2004/0095254 A1 5/2004 Maruszczak
2004/0117039 A1 6/2004 Hantke
2004/0178889 A1 9/2004 Buckingham
2004/0229569 A1 11/2004 Franz
2004/0257336 A1 12/2004 Hershkovitz
2005/0006528 A1 1/2005 Movsesian
2005/0007451 A1 1/2005 Chiang
2005/0040954 A1 2/2005 McNally
2005/0046584 A1 3/2005 Breed
2005/0057361 A1 3/2005 Giraldo
2005/0071879 A1 3/2005 Haldavnekar
2005/0097248 A1 5/2005 Kelley
2005/0116480 A1 6/2005 Deng
2005/0237208 A1 10/2005 Wojcik
2005/0259641 A1 11/2005 Beninato
2005/0267605 A1 12/2005 Lee
2005/0285934 A1 12/2005 Carter
2005/0285944 A1 12/2005 Watanabe
2006/0010504 A1 1/2006 Sharma
2006/0038663 A1 2/2006 Steinetz
2006/0063517 A1 3/2006 Oh
2006/0093187 A1 5/2006 Mittal
2006/0100002 A1 5/2006 Luebke
2006/0139449 A1 6/2006 Cheng
2006/0152365 A1 7/2006 Kim
2006/0156361 A1 7/2006 Wang
2006/0187034 A1 8/2006 Styers
2006/0195872 A1 8/2006 Seo
2006/0271678 A1 11/2006 Jessup
2006/0273895 A1 12/2006 Kollin
2007/0008081 A1 1/2007 Tylicki
2007/0012602 A1 1/2007 Baldassari
2007/0025712 A1 2/2007 Jezierski
2007/0029486 A1 2/2007 Zhevelev
2007/0046442 A1 3/2007 Bartorelli
2007/0052531 A1 3/2007 Matthews
2007/0066316 A1 3/2007 Hoover
2007/0103541 A1 5/2007 Barter
2007/0109441 A1 5/2007 Cheng
2007/0118831 A1 5/2007 Kondo
2007/0126574 A1 6/2007 Langer
2007/0132413 A1 6/2007 Mays
2007/0146115 A1 6/2007 Roosli
2007/0146122 A1 6/2007 Ratner
2007/0176778 A1 8/2007 Ando
2007/0194945 A1 8/2007 Atkinson
2007/0206510 A1 9/2007 Morris
2007/0216764 A1 9/2007 Kwak
2007/0237358 A1 10/2007 Tseng
2008/0004995 A1 1/2008 Klingenberg
2008/0028063 A1 1/2008 Holmes
2008/0036862 A1 2/2008 Lang
2008/0047287 A1 2/2008 Ruppert
2008/0128586 A1 6/2008 Johnson
2008/0129498 A1 6/2008 Howarter
2008/0129825 A1 6/2008 Deangelis
2008/0136915 A1 6/2008 Iwamura
2008/0145050 A1 6/2008 Mayer
2008/0157936 A1 7/2008 Ebrom
2008/0157956 A1 7/2008 Radivojevic
2008/0167072 A1 7/2008 Berstis
2008/0198225 A1 8/2008 Gal
2008/0297339 A1 12/2008 Mathews
2009/0059002 A1 3/2009 Kim
2009/0072963 A1 3/2009 Langer
2009/0093235 A1 4/2009 Grealish
2009/0141939 A1 6/2009 Chambers
2009/0167862 A1 7/2009 Jentoft
2009/0207249 A1 8/2009 Erel
2009/0213208 A1 8/2009 Glatt
2009/0243852 A1 10/2009 Haupt
2009/0273670 A1 11/2009 Tamayo
2009/0284578 A1 11/2009 Carter
2009/0296641 A1 12/2009 Bienas
2009/0302995 A1 12/2009 Park
2009/0308116 A1 12/2009 Lambrou
2010/0087161 A1 4/2010 Young
2010/0103300 A1 4/2010 Jones
2010/0109903 A1 5/2010 Carrick
2010/0134072 A1 6/2010 Neu
2010/0141761 A1 6/2010 McCormack
2010/0195810 A1 8/2010 Mota
2010/0225455 A1 9/2010 Claiborne
2010/0245060 A1 9/2010 Tylicki
2010/0276570 A1 11/2010 Moser
2010/0289661 A1 11/2010 Styers
2010/0321494 A1* 12/2010 Peterson ..... H04N 5/2254
348/143
2011/0025852 A1 2/2011 Tanaka
2011/0028118 A1 2/2011 Thomas
2011/0074570 A1 3/2011 Feldstein
2011/0090085 A1 4/2011 Belz
2011/0121940 A1 5/2011 Jones
2011/0140845 A1 6/2011 Sanders
2011/0156566 A1 6/2011 Chen
2011/0207509 A1 8/2011 Crawford
2011/0221582 A1 9/2011 Chuey
2011/0260880 A1 10/2011 Dean
2011/0264405 A1 10/2011 Vogel
2011/0287718 A1 11/2011 Abel
2011/0313775 A1 12/2011 Laligand
2012/0011559 A1 1/2012 Miettinen
2012/0027248 A1 2/2012 Feris
2012/0030133 A1 2/2012 Rademaker
2012/0044049 A1 2/2012 Vig
2012/0044050 A1 2/2012 Vig
2012/0044085 A1 2/2012 Hung
2012/0085824 A1 4/2012 Handshaw
2012/0098439 A1 4/2012 Recker
2012/0105631 A1 5/2012 Hutchings
2012/0108215 A1 5/2012 Kameli
2012/0113253 A1 5/2012 Slater
2012/0127308 A1 5/2012 Eldershaw
2012/0162416 A1 6/2012 Su
2012/0182427 A1 7/2012 Marshall
2012/0200942 A1 8/2012 Schmidt
2012/0229282 A1 9/2012 Zagami
2012/0230203 A1 9/2012 Casey
2012/0230696 A1 9/2012 Pederson
2012/0262581 A1 10/2012 Carter
2012/0267962 A1 10/2012 Hanchett
2012/0280783 A1 11/2012 Gerhardt
2012/0280789 A1 11/2012 Gerhardt
2012/0280790 A1 11/2012 Gerhardt
2012/0287123 A1 11/2012 Starner
2012/0293310 A1 11/2012 Fitzgibbon
2012/0320150 A1 12/2012 Montgomery
2012/0327225 A1 12/2012 Barley
2012/0327246 A1 12/2012 Senior
2013/0017812 A1 1/2013 Foster
2013/0020875 A1 1/2013 Wozniak
2013/0039499 A1 2/2013 Patenaude
2013/0045763 A1 2/2013 Ruiz

(56) References Cited

U.S. PATENT DOCUMENTS

| | | | |
|---|---|---|---|
| 2013/0057695 | A1 | 3/2013 | Huisking |
| 2013/0057696 | A1 | 3/2013 | Felt |
| 2013/0091213 | A1 | 4/2013 | Diab |
| 2013/0094444 | A1 | 4/2013 | Lai |
| 2013/0128050 | A1 | 5/2013 | Aghdasi |
| 2013/0130749 | A1 | 5/2013 | Andersen |
| 2013/0136033 | A1 | 5/2013 | Patil |
| 2013/0147616 | A1 | 6/2013 | Lambert |
| 2013/0147964 | A1 | 6/2013 | Frank |
| 2013/0169809 | A1 | 7/2013 | Grignan |
| 2013/0169814 | A1 | 7/2013 | Liu |
| 2013/0173477 | A1 | 7/2013 | Cairns |
| 2013/0208123 | A1 | 8/2013 | Lakhani |
| 2013/0223279 | A1 | 8/2013 | Tinnakornsrisuphap |
| 2013/0223833 | A1 | 8/2013 | Tenenbaum |
| 2013/0293722 | A1 | 11/2013 | Chen |
| 2013/0328522 | A1 | 12/2013 | Brockman |
| 2013/0335219 | A1 | 12/2013 | Malkowski |
| 2014/0009609 | A1 | 1/2014 | Webster |
| 2014/0015967 | A1 | 1/2014 | Moore |
| 2014/0070922 | A1 | 3/2014 | Davis |
| 2014/0077929 | A1 | 3/2014 | Dumas |
| 2014/0087780 | A1 | 3/2014 | Abhyanker |
| 2014/0088761 | A1 | 3/2014 | Shamlian |
| 2014/0118600 | A1 | 5/2014 | Son |
| 2014/0125754 | A1 | 5/2014 | Haywood |
| 2014/0149706 | A1 | 5/2014 | Shim |
| 2014/0167676 | A1 | 6/2014 | MacK |
| 2014/0188643 | A1 | 7/2014 | Murphy |
| 2014/0210590 | A1 | 7/2014 | Castro |
| 2014/0253725 | A1 | 9/2014 | Hsu |
| 2014/0260449 | A1 | 9/2014 | Uyeda |
| 2014/0265359 | A1 | 9/2014 | Cheng et al. |
| 2014/0266669 | A1 | 9/2014 | Fadell |
| 2014/0266767 | A1 | 9/2014 | Huang |
| 2014/0267716 | A1 | 9/2014 | Child |
| 2014/0267740 | A1 | 9/2014 | Almomani |
| 2014/0285672 | A1 | 9/2014 | Hogasten |
| 2014/0292194 | A1 | 10/2014 | Sagal |
| 2014/0292481 | A1 | 10/2014 | Dumas |
| 2014/0320663 | A1* | 10/2014 | Chien ..... G01S 3/7864 348/159 |
| 2014/0334684 | A1 | 11/2014 | Strimling |
| 2014/0340894 | A1 | 11/2014 | Chien |
| 2014/0368643 | A1 | 12/2014 | Siegel |
| 2015/0022319 | A1 | 1/2015 | Chutorash |
| 2015/0022618 | A1 | 1/2015 | Siminoff |
| 2015/0022620 | A1 | 1/2015 | Siminoff |
| 2015/0027178 | A1 | 1/2015 | Scalisi |
| 2015/0029335 | A1 | 1/2015 | Kasmir |
| 2015/0035987 | A1 | 2/2015 | Fernandez |
| 2015/0049191 | A1 | 2/2015 | Scalisi |
| 2015/0054949 | A1 | 2/2015 | Scalisi |
| 2015/0061859 | A1 | 3/2015 | Matsuoka |
| 2015/0063559 | A1 | 3/2015 | Siminoff |
| 2015/0070495 | A1 | 3/2015 | Scalisi |
| 2015/0084779 | A1 | 3/2015 | Saladin |
| 2015/0092055 | A1 | 4/2015 | Scalisi |
| 2015/0109104 | A1 | 4/2015 | Fadell |
| 2015/0109111 | A1 | 4/2015 | Lee |
| 2015/0109112 | A1 | 4/2015 | Fadell |
| 2015/0112885 | A1 | 4/2015 | Fadell |
| 2015/0120015 | A1 | 4/2015 | Fadell |
| 2015/0120598 | A1 | 4/2015 | Fadell |
| 2015/0127712 | A1 | 5/2015 | Fadell |
| 2015/0145991 | A1 | 5/2015 | Russell |
| 2015/0156030 | A1 | 6/2015 | Fadell |
| 2015/0156031 | A1 | 6/2015 | Fadell |
| 2015/0161856 | A1 | 6/2015 | Wilson |
| 2015/0163463 | A1 | 6/2015 | Hwang |
| 2015/0179031 | A1 | 6/2015 | Wallace |
| 2015/0185964 | A1 | 7/2015 | Stout |
| 2015/0194839 | A1 | 7/2015 | Wojcik |
| 2015/0208032 | A1 | 7/2015 | Gavney |
| 2015/0211259 | A1 | 7/2015 | Dumas |
| 2015/0213658 | A1 | 7/2015 | Dumas |
| 2015/0228281 | A1 | 8/2015 | Raniere |
| 2015/0236966 | A1 | 8/2015 | Francini |
| 2015/0275564 | A1 | 10/2015 | Rosenthal |
| 2015/0276266 | A1 | 10/2015 | Warren |
| 2015/0309487 | A1 | 10/2015 | Lyman |
| 2015/0310381 | A1 | 10/2015 | Lyman |
| 2015/0312531 | A1 | 10/2015 | Samad |
| 2015/0338812 | A1 | 11/2015 | Miura |
| 2015/0339895 | A1 | 11/2015 | Chen |
| 2016/0001719 | A1 | 1/2016 | Frost |
| 2016/0019495 | A1 | 1/2016 | Kolchin |
| 2016/0057199 | A1 | 2/2016 | Aziz |
| 2016/0058181 | A1 | 3/2016 | Han |
| 2016/0073479 | A1 | 3/2016 | Erchak |
| 2016/0078699 | A1 | 3/2016 | Kalb |
| 2016/0104061 | A1 | 4/2016 | McGill |
| 2016/0105644 | A1 | 4/2016 | Smith |
| 2016/0125357 | A1 | 5/2016 | Hall |
| 2016/0171435 | A1 | 6/2016 | Newton |
| 2016/0171439 | A1 | 6/2016 | Ladden |
| 2016/0191864 | A1 | 6/2016 | Siminoff |
| 2016/0219254 | A1 | 7/2016 | Hu |
| 2016/0235236 | A1 | 8/2016 | Byers |
| 2016/0247344 | A1 | 8/2016 | Eichenblatt |
| 2016/0261425 | A1 | 9/2016 | Horton |
| 2016/0292936 | A1 | 10/2016 | Palmer |
| 2016/0300187 | A1 | 10/2016 | Kashi |
| 2016/0307380 | A1 | 10/2016 | Ho |
| 2016/0330403 | A1 | 11/2016 | Siminoff |
| 2016/0366373 | A1 | 12/2016 | Siminoff |
| 2017/0023780 | A1 | 1/2017 | Braker |
| 2017/0064504 | A1 | 3/2017 | Jose |
| 2017/0124510 | A1 | 5/2017 | Caterino |
| 2017/0149855 | A1 | 5/2017 | Doshi |
| 2017/0160137 | A1 | 6/2017 | Jeong |
| 2017/0160138 | A1 | 6/2017 | Jeong |
| 2017/0160144 | A1 | 6/2017 | Jeong |
| 2017/0162225 | A1 | 6/2017 | Jeong |
| 2017/0163944 | A1 | 6/2017 | Jeong |
| 2017/0220872 | A1 | 8/2017 | Child |
| 2017/0251035 | A1 | 8/2017 | Siminoff |
| 2017/0251173 | A1 | 8/2017 | Siminoff |
| 2017/0251182 | A1 | 8/2017 | Siminoff |
| 2017/0272706 | A1 | 9/2017 | Jeong |
| 2017/0280112 | A1 | 9/2017 | Siminoff |
| 2017/0280565 | A1 | 9/2017 | Tso |
| 2017/0293883 | A1 | 10/2017 | Li |
| 2017/0294694 | A1 | 10/2017 | Tso |
| 2018/0019889 | A1 | 1/2018 | Burns |

FOREIGN PATENT DOCUMENTS

| | | | |
|---|---|---|---|
| CN | 202939738 | U | 5/2013 |
| EP | 0684743 | B1 | 11/1995 |
| GB | 2400958 | B | 7/2005 |
| WO | 2001093220 | A1 | 12/2001 |
| WO | 2007111802 | A2 | 10/2007 |
| WO | 2014062321 | A1 | 4/2014 |
| WO | 2014107196 | A1 | 7/2014 |
| WO | 2014144628 | A2 | 9/2014 |
| WO | 2015023737 | A1 | 2/2015 |
| WO | 2016032217 | A1 | 3/2016 |

OTHER PUBLICATIONS

The Next Web—Hardware renaissance: A look at the Christie Street platform and doorbot video streaming doorbell—Downloaded on Nov. 18, 2013 from http://thenextweb.com/insider/2012/12/10/satisfaction-lies-in-hardware-for-siminoffs-christie-street-platform-and-doorbot-video-streaming-doorbell/; prior art publication at least as of Dec. 10, 2012.

Digital Trends—Doorbot wi-fi doorbell camera lets you see visitors on your smartphone—Downloaded on Nov. 18, 2013 from http://www.digitaltrends.com/lifestyle/doorbot-camera-see-visitors-smartphone/; prior art publication at least as of Dec. 9, 2012.

(56) References Cited

OTHER PUBLICATIONS

DOORBOT website—Downloaded on Jul. 26, 2013 from http://www.getdoorbot.com.
DOORBOT users manual—Downloaded on Nov. 18, 2013 from http://static.mydoorbot.com/DoorBot%20Users%20Manual%201.0.pdf.
DOORBOT "fact sheet"—Downloaded on Nov. 18, 2013 from http://cdn.shopify.com/s/files/1/0247/6501/files/DoorBotMediaKit.pdf?17037.
Cellnock—Index page—Originally downloaded on Sep. 23, 2013 from http://cellnock.com/index.html; The website says CellNock is "patent pending".
Cellnock website—downloaded on Nov. 18, 2013 from http://cellnock.com/; The website says CellNock is "patent pending".
Philips InSight Baby Monitor—Originally downloaded on Jul. 24, 2013 from http://www.amazon.com/Philips-B120-37-InSight-Wireless/dp/B00AALO9Z6/ref=sr_1_3?ie=UTF8&qid=1384808431&sr=8-3&keywords=philips+insight.
Skybell—MySkyBell.com (previously iDoorCam.com)—Downloaded on Nov. 18, 2013 from http://www.myskybell.com/.
SQUARITZ IDS Doorbell System—Downloaded on Aug. 15, 2013 from http://www.indiegogo.com/projects/squaritz-ids-intelligent-doorbell-system.
Mybells—Downloaded on Nov. 18, 2013 from http://www.indiegogo.com/projects/mybells-the-smart-bells.
Wireless Video Doorbell Pager—Downloaded on Aug. 9, 2013 from http://www.indiegogo.com/projects/wireless-video-doorbell-pager--4.
Lockitron—Downloaded on Jul. 24, 2013 from https://lockitron.com/preorder.
Eyetalk for Home—Downloaded May 24, 2013 from http://www.revolutionaryconceptsinc.com/forhome.html.
Smartbell—Downloaded on Dec. 5, 2013 from http://smartbell.co/.
Smartbell—A Doorbell for Smartphones, published by Scrambled Brains Tech, LLC., Oct. 1, 2013.
August Smart Lock—Downloaded on Jun. 10, 2014 from www.August.com.
August Smart Lock—Downloaded on Oct. 10, 2014 from www.August.com.
KEVO Lock—User guide—Downloaded on Jun. 10, 2014 from http://s7d5.scene7.com/is/content/BDHHI/Kwikset/Website%20Content/Kevo/kevo-userguide-kwikset_eng.pdf.
KEVO Lock—Installation guide—Downloaded on Oct. 10, 2014 from http://s7d5.scene7.com/is/content/BDHHI/Kwikset/Website%20Content/Kevo/installation_guide.pdf.
Schlage Electronic Lock—User guide—Downloaded on Jun. 10, 2014 from www.schlage.com.
Adafruit—Lock-Style Solenoid—Downloaded on Aug. 22, 2014 from www.AdaFruit.com.
Wikipedia—Power Matters Alliance—Downloaded on Aug. 23, 2014 from www.wikipedia.com.
Adafruit—Push-Pull Solenoid—Technical Details—Downloaded on Aug. 22, 2014 from www.AdaFruit.com.
Wikipedia—Qi—Downloaded on Aug. 23, 2014 from www.wikipedia.com.
TP-Link—Website—Downloaded on Jul. 15, 2014 from www.tp-link.us.
A HD Cameras—AC Adapter Spy Camera—Downloaded on Jun. 24, 2014 from ahdcameras.com.
FANFARE Chime—Downloaded on Oct. 10, 2014 from https://www.kickstarter.com/projects/1040187373/1919517395?token=47099d90.
Ring Video Doorbell—Downloaded on Oct. 10, 2014 from www.ring.com.
Tech Crunch—Doorboot becomes Ring—Downloaded on Oct. 10, 2014 from http://techcrunch.com/2014/09/29/doorbot-ring-home-security-doorbell/?ncid=rss&utm_source=feedburner&utm_medium=feed&utm_campaign=Feed.
ICHIME—iChime Customizable Digital Chime System—Downloaded on Nov. 7, 2014 from http://www.ichime.com/.
Christie Streett—Doorbot—Downloaded on Jun. 14, 2013 from https://christiestreet.com/products/doorbot.
Idoorcam—A Wi-Fi Enabled, Webcam Doorbell—Downloaded on Sep. 3, 2013 from http://www.idoorcam.com/.
Langer—Langer Doorbell Button Sized Light—Downloaded on Sep. 16, 2013 from http://www.youtube.com/watch?v=u9nNCm4tSYI.
Langer—Langer Doorbell Light—Downloaded on Sep. 16, 2013 from http://www.youtube.corn/watch?v=6dbU-Gyjgx8.
Smartbell—SmartBell on Kickstarter—Downloaded on Feb. 28, 2014 from http://www.kickstartercom/projects/1256599792/smartbell-wi-fi-doorbell-for-video-chats-to-ios-an.
Defendoor—DefenDoor by Glate LLC—Downloaded on Dec. 11, 2014 from https://www.kickstarter.com/projects/85455040/defendoor-a-home-security-system-that-syncs-with-y.
CNET—Notifi by Chamberlain—Downloaded on Jan. 9, 2015 from http://www.cnet.com/products/chamberlain-notifi-video-door-chime/.
I-Bell—Downloaded on Jan. 13, 2015 from https://www.kickstarter.com/projects/729057054/i-bell.
Dropcam—Downloaded on Jan. 19, 2015 from https://www.dropcam.com/dropcam-pro.
Doorbird—Downloaded on Jan. 23, 2015 from http://www.doorbird.com/.
CHUI Doorbell—Downloaded on Jan. 23, 2015 from http://www.getchui.com/.
Tech Crunch—Chui Doorbell—Downloaded on Jan. 23, 2015 from http://techcrunch.com/2014/04/18/214-technologies-is-crowdfunding-a-smart-doorbell-called-chui/.
GIZ MAG—Downloaded on Jan. 23, 2015 from http://www.gizmag.com/gopano-micro-captures-360-degree-video-on-iphone/18542/.
Sengled Snap Light Camera—Downloaded on Mar. 9, 2015 from http://www.sengled.com/product/snap.
CNET—Alarm.com Garage Door Camera—Downloaded on Mar. 9, 2015 from http://www.cnet.com/au/products/alarm-com-for-apple-watch/.
Rollup iHome Peephole Doorbell—Downloaded on May 7, 2015 from http://www.rollupcn.com.
Tech Crunch—Ring Chime—Smart Chime—Downloaded on May 13, 2015 from http://techcrunch.com/2015/05/13/rings-smart-doorbell-gets-a-smart-speaker/#.y0xlqx:SpqY.
Peeple—Peephole Camera—Downloaded on May 14, 2015 from https://www.kickstarter.com/projects/1544392549/peeple-caller-id-for-your-front-door/video_share.
Vivant Doorbell Camera—Downloaded on May 20, 2015 from http://www.vivint.com/company/newsroom/press/Vivint-Introduces-Wi-Fi-Enabled-Doortell-Camera-into-Its-Smart-Home-Platform.
Myintercom Video System—Downloaded on Jun. 8, 2015 from http://myintercom.de/en/funktionsweise.
KOCCHI's Cobell Wi-Fi Doorbell—Downloaded on Sep. 14, 2015 from http://www.kocchis.com/Cobell_Manual.pdf.
August Doorbell Cam—Downloaded on Nov. 12, 2015 from http://august.com/products/august-doorbell/.
Nest Home Index—Downloaded on Nov. 12, 2015 from https://nest.com/blog/2015/11/09/the-first-nest-home-index/?utm_medium=paid%20social&utm_source=Facebook&utm_campaign=Nest%20Home%20Index&utm_content=Launch%20post.
Engadget—Amazon partners are reportedly exploring in-home deliveries—Downloaded on Oct. 19, 2017 from https://www.engadget.com/2016/09/27/amazon-august-garageio-inhome/; prior art publication at least as of Sep. 27, 2016.
Logitech—Logitech Circle 2—Downloaded on Oct. 19, 2017 from from https://www.logitech.com/en-us/product/circle-2-home-security-camera; prior art publication at least as of Jul. 26, 2017.
NY Times—Was That an Intruder or a Pet? The Security Cams That Can Tell—Downloaded on Oct. 19, 2017 from https://www.nytimes.com/2017/08/09/technology/personaltech/internet-connected-security-cameras-wirecutter.html?rref=collection%2Fsectioncollection%2Fpersonaltech; prior art publication at least as of Aug. 10, 2017.
WISENET—SmartCam D1—Downloaded on Oct. 19, 2017 from http://www.wisenetlife.com/en-us/product/smartCam/SNH-V6435DN;jsessionid=023065D418C9E9CA7335F6D9B4E2C8DC/faq/?currtPg=4; prior art publication at least as of Sep. 23, 2017.

(56) References Cited

OTHER PUBLICATIONS

NORTEK Control—Go Control: Smart Doorbell Camera—Downloaded on Oct. 19, 2017 from https://www.nortekcontrol.com/pdf/literature/GC-DBC-1-GoControl-Smart-Doorbell-Camera-Spec-Sheet.pdf; prior art publication at least as of Dec. 18, 2016.
HSN—Samsung SmartCam High-Definition Video Doorbell—Downloaded on Oct. 25, 2017 from https://www.hsn.com/products/samsung-smartcam-high-definition-video-doorbell/8534791; prior art publication at least as of Oct. 22, 2017.
Wirecutter—The Best Smart Doorbell Camera—Downloaded on Oct. 25, 2017 from https://thewirecutter.com/reviews/best-smart-doorbell-camera/; prior art publication at least as of Oct. 19, 2017.
Newsday—Google's Nest launches video doorbell, new security system—Downloaded on Oct. 25, 2017 from https://www.newsday.com/lifestyle/google-s-nest-launches-video-doorbell-new-security-system-1.14498694; prior art publication at least as of Oct. 18, 2017.
ZA NET—Amazon to develop a smart doorbell to deliver packages inside your home—Downloaded on Oct. 25, 2017 from http://www.zdnet.com/article/amazon-plans-to-develop-smart-doorbell-to-deliver-packages-inside-your-home/; prior art publication at least as of Oct. 11, 2017.
Dealerscope—Petra Named Exclusive Distributor for New Uniden U-Bell DB1 Wireless Video Doorbell Downloaded on Oct. 25, 2017 from http://www.dealerscope.com/article/petra-named-exclusive-distributor-new-uniden-u-bell-db1-wireless-video-doorbell/; prior art publication at least as of Oct. 3, 2017.
Nest—Say hello to Nest Hello—Downloaded on Oct. 25, 2017 from https://nest.com/blog/2017/09/20/say-hello-to-nest-hello/?utm_campaign=nest%20hello%20preannounce&utm_source=nest%20customers&utm_medium=m-email&utm_opntent=learn%20more; prior art publication at least as of Sep. 27, 2017.
Gate: Your Personal Doorman—Downloaded on Oct. 25, 2017 from https://www.indiegogo.com/projects/gate-your-personal-doorman#/; prior art publication at least as of Sep. 25, 2017.
Mashable—Walmart is teaming with a smart lock startup to deliver food straight to your fridge—Downloaded on Oct. 25, 2017 from http://mashable.com/2017/09/24/walmart-smart-lock-grocery-delivery/#7b0i0W4L_mqf; prior art publication at least as of Sep. 24, 2017.
Wired—Review: August Smart Lock—Downloaded on Oct. 25, 2017 from https://www.wired.com/2017/09/review-august-smart-lock/; prior art publication at least as of Sep. 24, 2017.
Amazon—Amazon Key—Downloaded on Oct. 25, 2017 from https://www.amazon.com/b?ie=UTF8&node=17285120011.
Amazon—Amazon Key In-Home Kit includes: Amazon Cloud Cam (Key Edition) indoor security camera and compatible smart lock—Downloaded on Oct. 25, 2017 from https://www.amazon.com/dp/B00KCYQGXE?locationCheckInvoked=1.
Amazon—Amazon Cloud Cam Indoor Security Camera, works with Alexa—Downloaded on Oct. 25, 2017 from https://www.amazon.com/Amazon-Cloud-Indoor-Security-Camera/dp/B01C4UY0JK/ref=sr_tr_1?s=amazon-devices&ie=UTF8&qid=1508945752&sr=1-1&keywords=amazon+cloud+cam.
Best Buy—Vivint Smart Home—Downloaded on Oct. 25, 2017 from https://www.bestbuy.com/site/home-security-solutions/smart-home/pcmcat748302047019.c?id=pcmcat748302047019&ref=P30T29R169&loc=BODY&CampaignID=860152&eut=2387920889; prior art publication at least as of Aug. 25, 2017.
Ring—Chime Pro—Downloaded on Oct. 25, 2017 from https://ring.com/chime-pro; prior art publication at least as of Aug. 23, 2017.
Twice—Samsung Wisenet SmartCam D1 Video Doorbell—Downloaded on Oct. 25, 2017 from http://www.twice.com/news/smart-home/samsung-wisenet-smartcam-d1-video-doorbell/65643; prior art publication at least as of Jul. 31, 2017.
Tech Crunch—Ring adds three connected Spotlight Cams to its Floodlight Cam lineup—Downloaded on Oct. 25, 2017 from https://techcrunch.com/2017/07/31/ring-adds-three-connected-spotlight-cams-to-its-floodlight-cam-lineup/; prior art publication at least as of Aug. 2, 2017.
CNBC—This $200 'smart' doorbell will show you who (or what) is in front of your house at all times—Downloaded on Oct. 25, 2017 from https://www.cnbc.com/2017/07/23/ring-doorbell-2-review.html; prior art publication at least as of Jul. 23, 2017.
ZMODO—Greet Pro with Beam Alert—Downloaded on Oct. 25, 2017 from http://www.zmodo.com/greetpro-1080p-wifi-video-doorbell/.
August—August Doorbell Cam Pro—Downloaded on Oct. 25, 2017 from http://august.com/products/doorbell-camera/?utm_source=Owners+from+Salesforce&utm_campaign=83b33655ed-EMAIL_CAMPAIGN_2017_06_06&utm_medium=email&utm_term=0_15a5cc0eb8-83b33655ed-247286221&mc_cid=83b33655ed&mc_eid=9d1996d140; prior art publication at least as of Jun. 11, 2017.
ATT—August Wi-Fi Doorbell Cam—Downloaded on Oct. 25, 2017 from https://m.att.com/shopmobile/accessories/specialty-items/August_Wi-Fi_Doorbell_Cam/_jcr_content.html?referrer=https%253A%2F%2Fwww.google.com%2F; prior art publication at least as of Jun. 9, 2017.
Ding, a beautifully simple smart doorbell—Downloaded on Oct. 25, 2017 from https://www.indiegogo.com/projects/ding-a-beautifully-simple-smart-doorbell-home-technology#/; prior art publication at least as of Jun. 5, 2017.
Clare Controls—The Clare Video Doorbell—Downloaded on Oct. 25, 2017 from https://www.clarecontrols.com/video-doorbell; prior art publication at least as of Jun. 1, 2017.
Business Insider—The best security cameras you can buy for your home—Downloaded on Oct. 25, 2017 from http://www.businessinsider.com/best-security-camera-home/#the-best-home-security-camera-for-outdoors-and-indoors-2; prior art publication at least as of May 27, 2017.
SMANOS—Smart Video Doorbell—Downloaded on Oct. 25, 2017 from http://www.smanos.com/doorbell; prior art publication at least as of May 22, 2017.
Ring—Products—Downloaded on Oct. 30, 2017 from https://ring.com/.
Honeywell RCWL105A1003/N Plug-in Wireless Doorbell / Door Chime and Push Button; Downloaded on Apr. 16, 2019 from https://www.amazon.com/Honeywell-RCWL105A1003-Plug-Wireless-Button/dp/B001G0MATM; Prior art at least as of Sep. 26, 2008.
SADO Tech Model C Wireless Doorbell Operating at over 500-feet Range with Over 50 Chimes, No Batteries Required for Receiver; Downloaded on Apr. 16, 2019 from https://www.amazon.com/SadoTech-Wireless-Doorbell-Operating-Batteries/dp/B00FR4YQYK; Prior art at least as of Oct. 10, 2013.
Zheludev; The life and times of the LED—a 100-year history; Nature Photonics; Apr. 2007, pp. 189-192; vol. 1; Nature Publishing Group; Retrieved Apr. 16, 2019.
Yam; Innovative Advances in LED Technology; Microelectronics journal; Nov. 9, 2004; pp. 129-137; vol. 36; Retrieved Apr. 16, 2019.
Perkin Elmer; LHi968—LHi 968 Dual Element Detector, Top Line; Prior art at least as of Mar. 18, 2007.
Perkin Elmer; Pyroelectric Infrared Detectors; Prior art at least as of Apr. 16, 2009.
Perkin Elmer; Dual Element Detector; Prior art at least as of Mar. 25, 2007.
IEEE Standards Association; IEEE 802.15.1-2002—IEEE Standard for Telecommunications and Information Exchange Between Systems—LAN/MAN—Specific Requirements—Part 15: Wireless Medium Access Control (MAC) and Physical Layer (PHY) Specifications for Wireless Personal Area Networks (WPANs); Downloaded on Apr. 29, 2019 from https://standards.ieee.org/standard/802_15_1-2002.html ; Prior art at least as of Jun. 14, 2002.
Bluetooth—Our History; Prior art least as of Oct. 17, 2013.
Nutone—LA600WH Door Chime—Installation & Operating Instructions; Downloaded on Apr. 29, 2019 from http://www.nutone.com/common/productDigitalAssethandler.ashx?id=5b25a40a-c56f-44bf-99d1-5b0c17f266e9; Prior art at least as of Sep. 18, 2013.
Nutone; LA600WH Universal Wired/Wireless MP3 Doorbell Mechanism, 6"w x 9-1/2"h x 2-1/4"d in White; Downloaded on Apr. 29, 2019 from http://www.nutone.com/products/product/e2562b0e-4fe5-432a-ac70-228953b19875; Prior art at least as of May 30, 2013.

(56) References Cited

OTHER PUBLICATIONS

Intune; InTune MP3 Door Chime Manual; Downloaded on Apr. 29, 2019 from https://www.heath-zenith.com/system/spree/documents/attachments/000/000/839/original/205371-02A.pdf?1436551434 ; Prior art at least as of 2013.
Nutone; College Pride Mechanism; Prior art at least as of Jun. 8, 2013.
SECO-LARM; Enforcer DP-236Q Wireless Video Door Phone Manual; Downloaded on Apr. 29, 2019 from http://www.seco-larm.com/image/data/A_Documents/02_Manuals/MiDP-236Q_150528.pdf.

* cited by examiner

OUTDOOR SECURITY SYSTEMS AND METHODS

CROSS-REFERENCE TO RELATED APPLICATIONS

This application claims the benefit of and is a continuation-in-part of U.S. Nonprovisional patent application Ser. No. 16/055,115; filed Aug. 5, 2018; and entitled OUTDOOR SECURITY SYSTEMS AND METHODS; the entire contents of which are incorporated herein by reference.

U.S. Nonprovisional patent application Ser. No. 16/055,115 claims the benefit of U.S. Provisional Patent Application No. 62/560,118, filed Sep. 18, 2017; entitled OUTDOOR SECURITY SYSTEMS AND METHODS; the entire contents of which are incorporated herein by reference.

BACKGROUND

Field

Various embodiments disclosed herein relate to security systems. Certain embodiments relate to outdoor security systems.

Description of Related Art

Homes, offices, and other buildings sometimes include security systems to enable occupants of the buildings to remotely monitor their premises to deter and prevent unwanted visitors. One shortcoming of such security systems is that they are easily noticeable and therefore avoidable by perpetrators. Thus, there is a need for undiscernable security systems and methods to monitor premises.

SUMMARY

This disclosure includes a security system comprising an outdoor security device (e.g., a weatherproof security device) including a housing elongate along a first direction. The housing may comprise a top end, a bottom end located opposite the top end, and a hollow inner portion. The security device may include a light coupled to the housing and located within the hollow inner portion adjacent the bottom end. The light may face towards the top end. The security device may also include a camera coupled to the housing. The camera may face towards at least one of the top end and the bottom end. The security device may include a visual adjustment device coupled to the housing and aligned with an optical axis of the camera. The visual adjustment device may be arranged and configured to allow the camera to capture images along a radial direction around the security device. The radial direction may be perpendicular to the first direction.

In some embodiments, the visual adjustment device is located closer to the top end than the bottom end. In some embodiments, the visual adjustment device is coupled to the top end and the camera is located closer to the bottom end than the top end and the camera faces the top end. The camera may be located closer to the top end than the bottom end and the camera may face the bottom end.

The visual adjustment device may comprise at least one of a mirror and lens. In some embodiments, the visual adjustment device comprises a cone-shaped mirror that radially extends at least 90-degrees around a perimeter of the camera so that the camera captures images at least 90-degrees around a perimeter of the housing along a second direction that is perpendicular to the first direction. As well, in some embodiments, the visual adjustment device comprises a cone-shaped mirror that radially extends at least 180-degrees around a perimeter of the camera so that the camera captures images at least 180-degrees around a perimeter of the housing along a second direction that is perpendicular to the first direction. Even still, in some embodiments, the visual adjustment device comprises a cone-shaped mirror that radially extends 360-degrees around a perimeter of the camera so that the camera captures images 360-degrees around a perimeter of the housing along a second direction that is perpendicular to the first direction.

The security system may also include a remote computing device communicatively coupled to the camera and/or the security device. The weatherproof security device may be a first weatherproof security device and the system may further comprise a second weatherproof security device communicatively coupled to at least one of the first weatherproof security device and the remote computing device. The remote computing device may be a first remote computing device and the system may further include a second remote computing device communicatively coupled to at least one of the weatherproof security device and the first remote computing device. Even still, the weatherproof security device may be a first weatherproof security device and the system may further comprise a second weatherproof security device communicatively coupled to at least one of the first weatherproof security device, the first remote computing device, and the second remote computing device.

The weatherproof security device may further comprise a microphone coupled to the housing and a speaker coupled to the housing. The microphone and speaker may be arranged and configured to enable two-way communication between the weatherproof security device and the remote computing device. In some embodiments, the light is coupled to the housing via a low voltage electrical connection whereby the light receives electrical power from the low voltage electrical connection.

The camera may be coupled to the housing via a low voltage electrical connection wherein the camera receives electrical power from the low voltage electrical connection. The security system may further include a low voltage electrical cable and plug extending from the housing. At least one of the light and the camera may receive electrical power from the low voltage electrical cable and plug.

In some embodiments, the housing comprises a tube elongate along the first direction, and a base coupled to the elongate tube. The base may be rotatably coupled to the tube. In some embodiments, the base further comprises at least one aperture extending through the base such that moisture is able to escape the hollow inner portion of the housing. Even still, the system may further comprise a stake extending from the base along a third direction opposite the first direction.

Furthermore, in some embodiments, the visual adjustment device is rotatably coupled to the housing. As well, the camera and the light may be slideably coupled to the housing. The security system may further comprise a transparent material radially extending around the visual adjustment device. The transparent material may comprise at least one of glass, plastic, polycarbonate, and acrylic.

The security system may include a wireless communication module coupled to the housing. The wireless communication module may comprise at least one of a Wi-Fi extender, Wi-Fi booster, and Wi-Fi repeater. The wireless communication module may be coupled to the housing via a low voltage electrical connection. The wireless communication module may receive electrical power from the low voltage electrical connection.

In some embodiments, the system includes an antenna communicatively coupled to the wireless communication module. The antenna may be coupled to an outer surface of the housing. As well, the antenna may be located within the hollow inner portion.

The disclosure also includes a low voltage security device that includes a housing, a camera coupled to the housing, and a low voltage electrical connection coupled to the housing and electrically coupled to the camera. In some embodiments, the security device further includes a wireless communication module coupled to the housing and communicatively coupled to the camera. The wireless communication module may be arranged and configured to transmit images captured by the camera to a remote computing device.

The low voltage electrical connection may comprise a male connection configured to electrically couple to a low voltage female connection. Even still, the low voltage electrical connection may comprise a female connection configured to electrically couple to a low voltage male connection. The security device may include a light coupled to the housing, In this regard, the low voltage electrical connection may be electrically coupled to the light.

The disclosure also includes a wireless communication system comprising a weatherproof housing, a Wi-Fi extender coupled to the weatherproof housing, and a low voltage electrical connection coupled to the weatherproof housing and electrically coupled to the Wi-Fi extender. The system may further comprise an antenna communicatively coupled to the Wi-Fi extender. In some embodiments, the antenna is coupled to an outer surface of the weatherproof housing. Even still, in some embodiments, the antenna is located within an inner portion of the weatherproof housing.

Additionally, the disclosure includes a security system comprising an outdoor security device including a housing elongate along a first direction, the housing comprising a top end, a bottom end, and a hollow inner portion; a light coupled to the housing and located within the hollow inner portion; a camera and a lens coupled to the housing, the lens located between the camera and the top end such that the camera is configured to capture images around a perimeter of the outdoor security device; and at least one directional microphone communicatively coupled to the camera and configured to determine a location of a detected sound whereby the camera performs a frame lock to capture an image associated with the detected sound.

In some embodiments, the at least one directional microphone comprises a first port and a second port configured to determine the location of the detected sound whereby the camera performs the frame lock to capture the image associated with the detected sound.

In some embodiments, the at least one directional microphone comprises a first directional microphone and a second directional microphone each communicatively coupled to the camera, the first directional microphone and the second directional microphone located on opposite sides of the housing and configured to determine the location of the detected sound whereby the camera performs the frame lock to capture the image associated with the detected sound.

In some embodiments, the system includes a visual adjustment device coupled to the housing and located along the hollow inner portion of the housing adjacent the top end, wherein the visual adjustment device is aligned with the lens and the camera such that the visual adjustment device is configured to allow the camera to capture images around the perimeter of the outdoor security device. In some embodiments, the visual adjustment device comprises a cone-shaped mirror having a tip facing towards the camera and the lens. The lens may comprise a flat lens. In some embodiments, the lens comprises a convex lens configured to allow the camera to capture images around the perimeter of the outdoor security device.

In some embodiments, the camera is configured to capture images 360-degrees around the outdoor security device. In some embodiments, the camera is configured to capture images along a vertical field of view that is less than or equal to about 220-degrees.

In some embodiments, the system includes a substantially clear portion coupled to the housing and located adjacent the top end, wherein the camera is configured to capture images around the perimeter of the outdoor security device through the substantially clear portion.

In some embodiments, the system includes a power cord electrically coupled to at least one of the battery, the light, the camera, and the least one directional microphone, wherein the power cord is configured to receive power from an external power source.

In some embodiments, the system includes a battery electrically coupled to at least one of the power cord, the light, the camera, and the at least one directional microphone, wherein the battery is configured to be recharged via power received from the power cord, and the battery is configured to thereby provide power to at least one of the light, the camera, and the at least one directional microphone.

In some embodiments, the system includes a remote server communicatively coupled to at least one of the light, the camera, and the at least one directional microphone.

In some embodiments, the system includes a remote computing device communicatively coupled to least one of the light, the camera, the at least one directional microphone, and the remote server, wherein the remote computing device is configured to receive an alert in response to the at least one directional microphone receiving the detected sound.

In some embodiments, the light is configured to illuminate an area around the outdoor security device. As well, in some embodiments, the light is configured to illuminate and pulse in a strobing pattern. In some embodiments, the strobing pattern comprises a plurality of colors. Additionally, in some embodiments, the strobing pattern comprises a plurality of pulse rates.

In some embodiments, the system includes a speaker coupled to the housing and communicatively coupled to at least one of the light, the camera, and the at least one directional microphone.

In some embodiments, the system includes a wireless communication module coupled to the housing, wherein the wireless communication module comprises at least one of a Wi-Fi extender, Wi-Fi booster, and Wi-Fi repeater; and an antenna coupled to the housing and communicatively coupled to the wireless communication module.

The disclosure also includes methods of using a security system that includes an outdoor security device comprising the steps of providing the outdoor security device comprising a housing, a light located within a hollow inner portion of the housing, a camera and a lens coupled to the housing whereby the lens is located between the camera and a top end of the housing, and at least one directional microphone communicatively coupled to the camera and configured to determine a location of a detected sound. Methods may also include detecting a sound via the at least one directional microphone; and in response to the detecting, capturing, via the camera, an image associated with the sound.

In some embodiments, the capturing comprises the camera performing a frame lock of the image associated with the detected sound. In some embodiments, the detecting comprises detecting the sound along a radial field of view that is 360-degrees around the outdoor security device and a vertical field of view up to 220-degrees from the outdoor security device.

In some embodiments, the method includes comprising providing power to at least one of the battery, the light, the camera, and the at least one directional microphone via a power cord electrically coupled to an external power source.

In some embodiments, the method includes providing power to at least one of the light, the camera, and the at least one directional microphone via a battery electrically coupled to the housing.

In some embodiments, the method includes providing power to at least one of the battery, the light, the camera, and the at least one directional microphone via the power cord during a first time interval; and providing power to at least one of the light, the camera, and the at least one directional microphone via the battery during a second time interval.

In some embodiments, the method includes recharging the battery via the power cord and the external power source during at least one of the first time interval and the second time interval.

In some embodiments, the method includes, in response to the detecting, receiving, via a remote computing device, an alert. In some embodiments, the method includes, in response to the detecting, illuminating the light and pulsing the light in a strobing pattern. In some embodiments, the method includes, in response to the detecting, emitting a sound from a speaker coupled to the housing and communicatively coupled to at least one of the light, the camera, and the at least one directional microphone.

The embodiments described above include many optional features and aspects. Features and aspects of the embodiments can be combined.

BRIEF DESCRIPTION OF THE DRAWINGS

These and other features, aspects, and advantages are described below with reference to the drawings, which are intended to illustrate, but not to limit, the invention. In the drawings, like reference characters denote corresponding features consistently throughout similar embodiments.

DETAILED DESCRIPTION

Although certain embodiments and examples are disclosed below, inventive subject matter extends beyond the specifically disclosed embodiments to other alternative embodiments and/or uses, and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components.

For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

Communication systems can provide a secure and convenient way for a remotely located individual to communicate with a person who is approaching a sensor, such as a proximity sensor or motion sensor, or with a person who rings a doorbell, which can be located in a doorway, near an entrance, or within 15 feet of a door. Some communication systems allow an individual to hear, see, and talk with visitors who approach at least a portion of the communication system and/or press a button, such as a doorbell's button. For example, communication systems can use a computing device to enable a remotely located person to see, hear, and/or talk with visitors. Computing devices can include computers, laptops, tablets, mobile devices, smartphones, cellular phones, and wireless devices (e.g., cars with wireless communication). Example computing devices include the iPhone, iPad, iMac, MacBook Air, and MacBook Pro made by Apple Inc. Communication between a remotely located person and a visitor can occur via the Internet, cellular networks, telecommunication networks, and wireless networks.

COMPONENT INDEX

Figure 1:
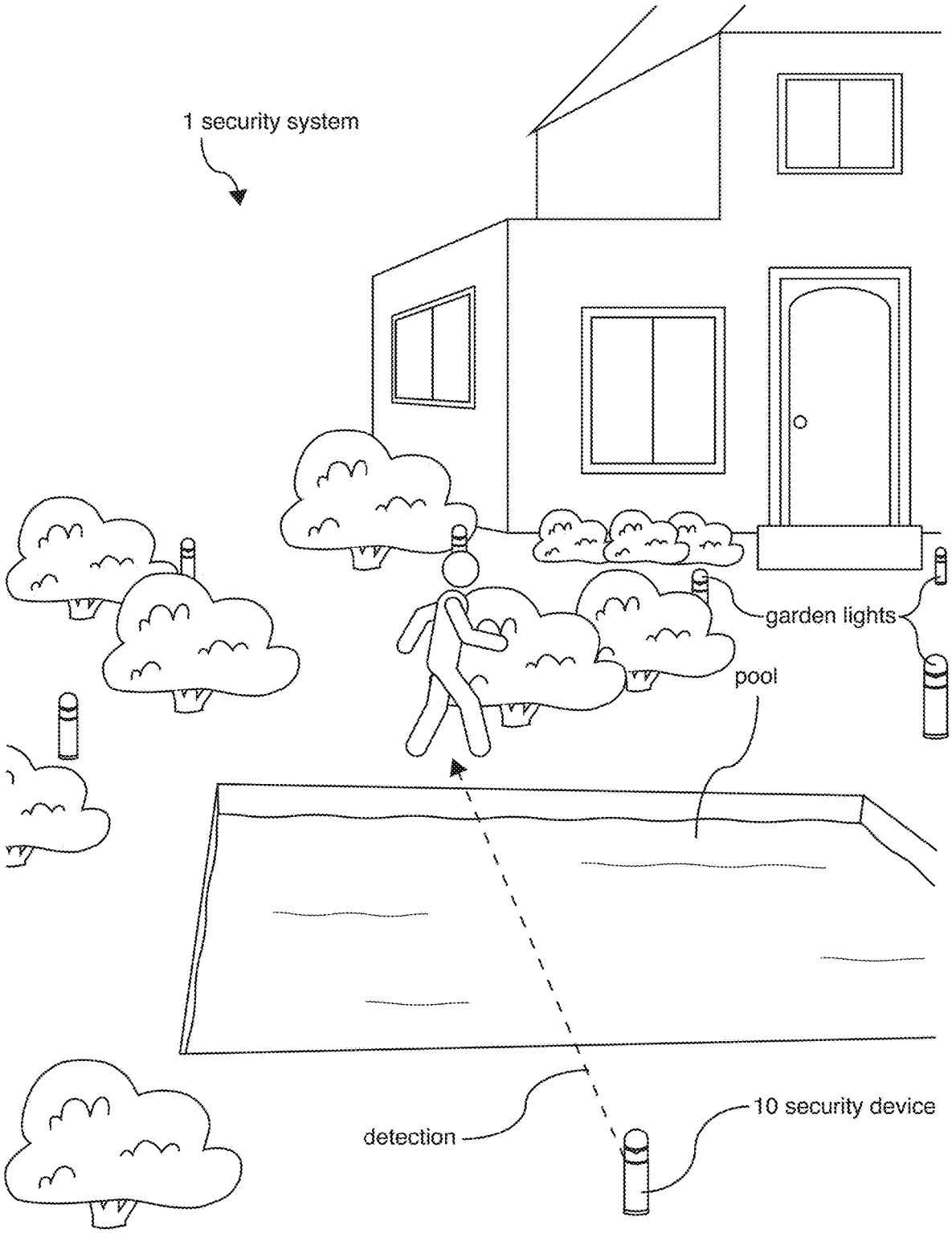
FIG. 1 illustrates a security device in an environment of use, according to some embodiments.

1—security system
10—security device
12—housing
14—top end
16—bottom end
17—inner portion
20—light
22—camera
23—lens
24—visual adjustment device
26—optical axis
28—motion detector
30—remote computing device
32—remote server
34—the cloud
40—low voltage connection
41—power cord
43—battery
44—tube
45—external power
46—base
48—aperture
50—stake
52—transparent material
54—microphone
55—at least one directional microphone
55*a*—first directional microphone
55*b*—second directional microphone
56—speaker
58*a*—first port
58*b*—second port
60—wireless communication module
62—antenna
64—field of view
66—radial field of view
67—vertical field of view
68—wireless communication
70—image frame lock
72—remote sensor FIG. 1 illustrates a security device 10 located in an environment of use, such as a residential backyard. While in use, the security device 10 may visually and audibly detect motion and sounds in the backyard environment and then send a notification to a remote computing device to alert the resident, or other person, of the detected motion and/or sound. The security device 10 may have a substantially similar aesthetic appearance to a standard garden light, as shown in FIG. 1. In this regard, the security device 10 may blend in with its surroundings whereby unsuspecting trespassers are unable to distinguish between the security device 10 and the standard garden light. For the purposes of this disclosure, the terms weatherproof and outdoor may be used interchangeably. In some embodiments, a security system 1 comprises a plurality of security devices working as a security network. For example the system 1 may include a first outdoor security device 10*a*, a second outdoor security device 10*b*, a third outdoor security device 10*c*, and so on. The network may comprise similar or different security devices 10 utilizing some or all of the functionality and components described throughout this disclosure.

Figure 2:
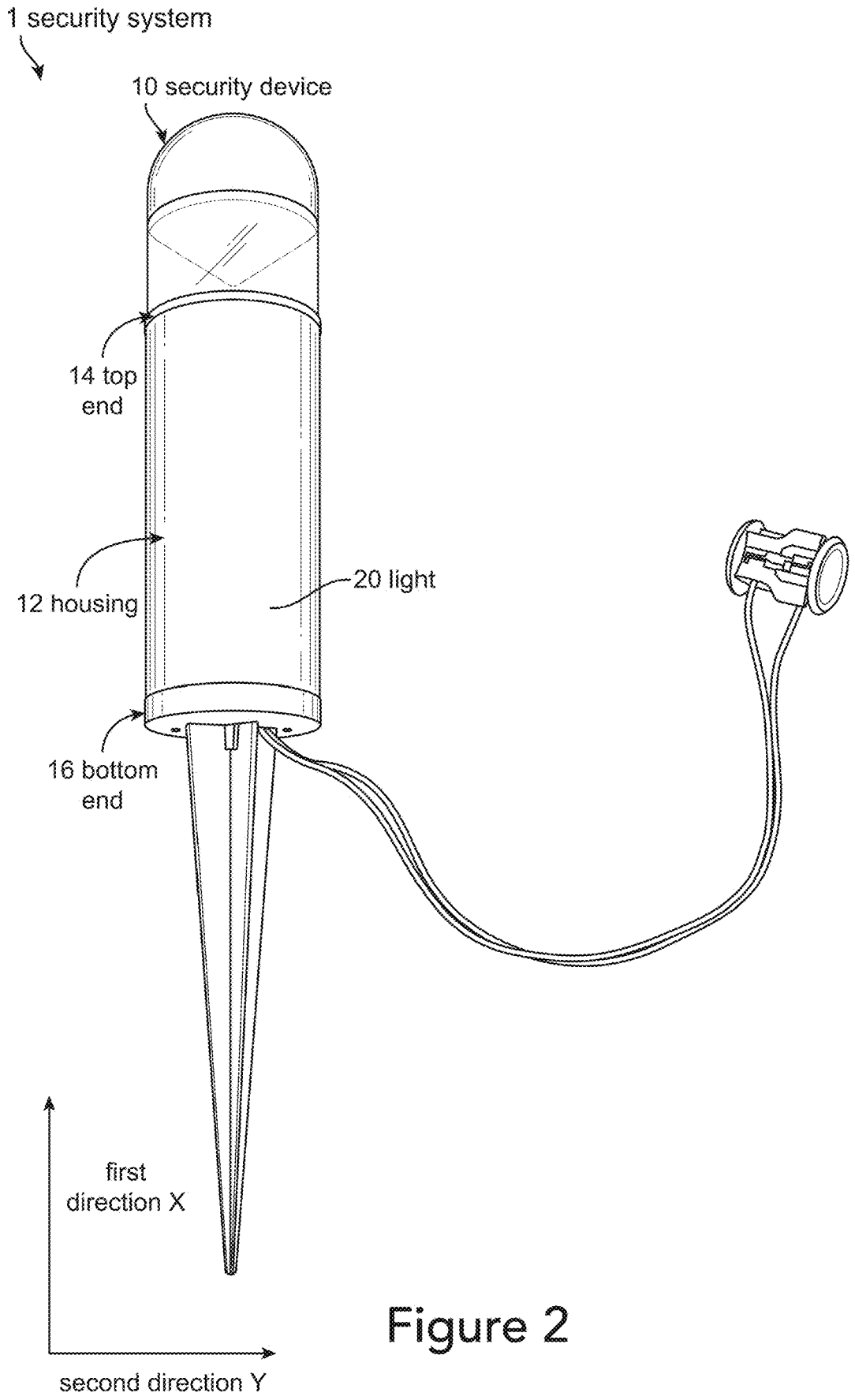
FIG. 2 illustrates a front view of a security device, according to some embodiments.

FIG. 2 illustrates a front view of a security system 1 comprising a weatherproof security device 10 that includes a housing 12 elongate along a first direction X. The housing 12 may comprise a top end 14, a bottom end 16 located opposite the top end 14, and a hollow inner portion. The security device 10 may also include a light 20 coupled to the housing 12 and located within the hollow inner portion 17 adjacent the bottom end 16. In some embodiments, the light 20 faces towards the top end 14.

Figure 3:
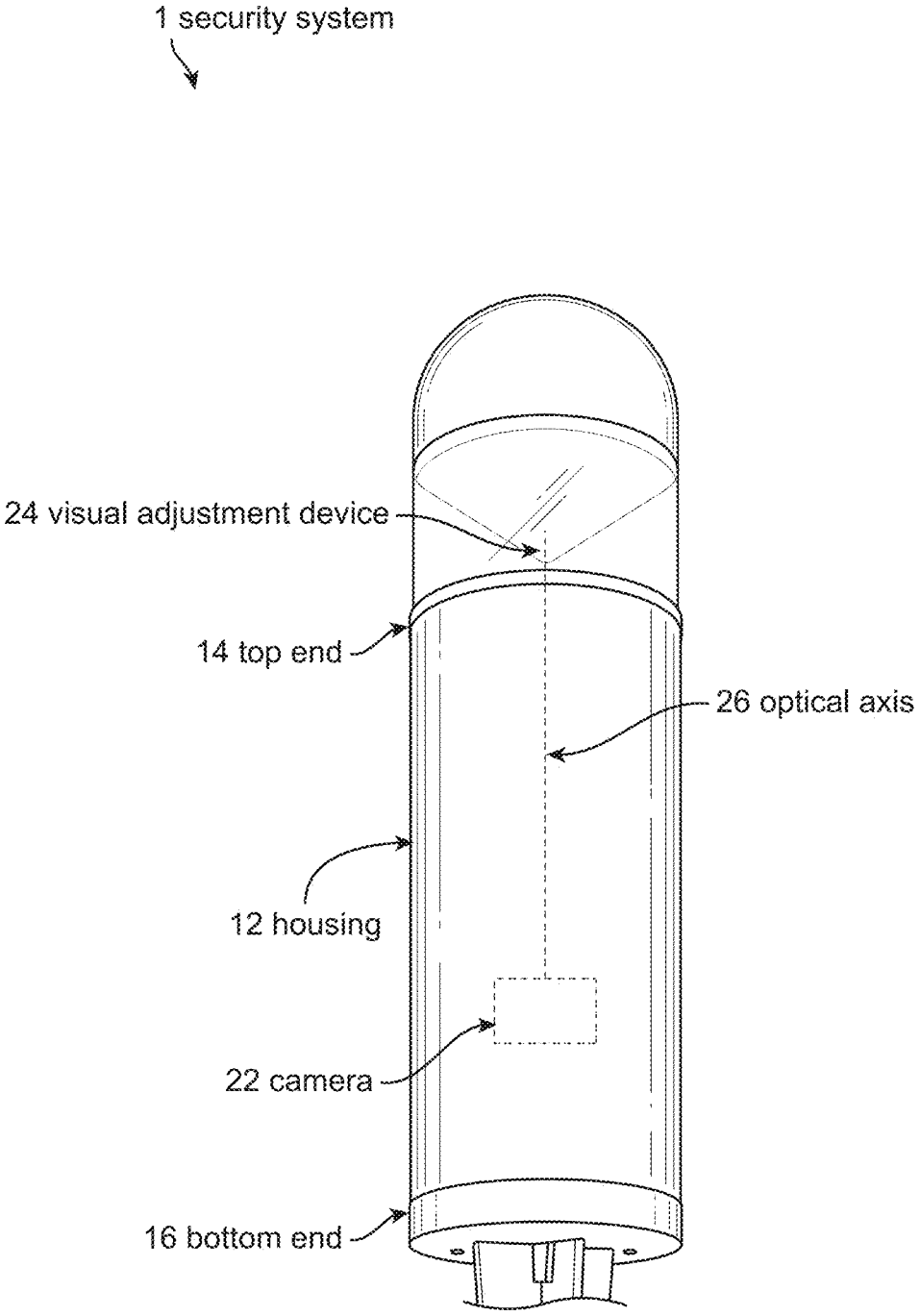
FIGS. 3 and 4 illustrate front views of security devices having a camera and an optical axis, according to some embodiments.
Figure 4:
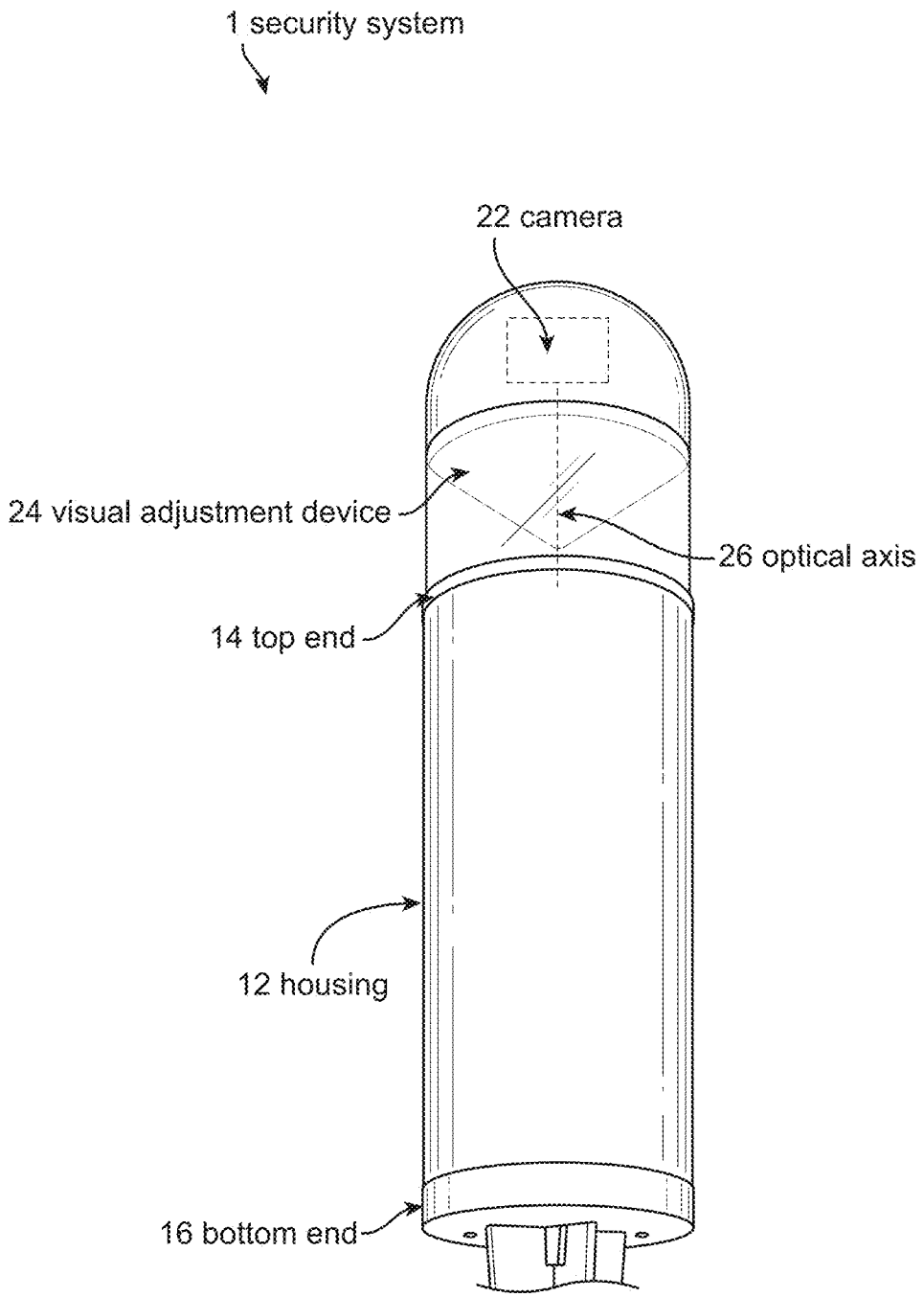

According to FIGS. 3 and 4, the security device 10 may also include a camera 22 coupled to the housing 12, and a visual adjustment device 24 coupled to the housing 12 and aligned with an optical axis 26 of the camera 22. The visual adjustment device 24 may be arranged and configured to allow the camera 22 to capture images along a radial direction (or second direction Y) around the security device 1. The visual adjustment device 24 may comprise a mirror and/or a lens, whereby either is arranged and configured to enhance the focus and/or capture images radially located around the security device. According to FIG. 2, the radial direction is perpendicular to the first direction X.

As shown in FIGS. 3 and 4, the visual adjustment device 24 may be located closer to the top end 14 than the bottom end 16. In some embodiments, the visual adjustment device 24 is directly or indirectly coupled to the top end 14. As shown in FIG. 3, the camera 22 may be located closer to the bottom end 16 than the top end 14. In this regard the camera 22 may face the top end 14 and/or the visual adjustment device 24. Alternatively, as shown in FIG. 4, the camera 22 may be located closer to the top end 14 than the bottom end 16. Accordingly, the camera 22 may face the bottom end 16 and/or the visual adjustment device 24. In many embodiments, the camera 22 faces the visual adjustment device 24 so that the camera 22 can capture images radially located around the security device 10.

Figure 5A:
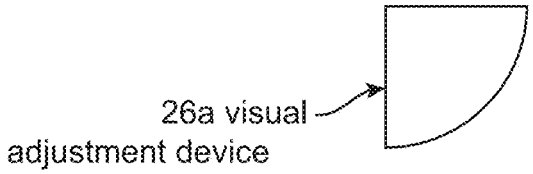
FIGS. 5*a*, 5*b*, and 5*c* illustrate top views of visual adjustment devices, according to some embodiments.
Figure 5B:
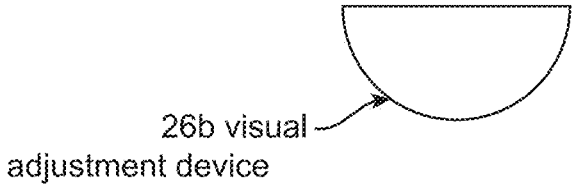
Figure 5C:
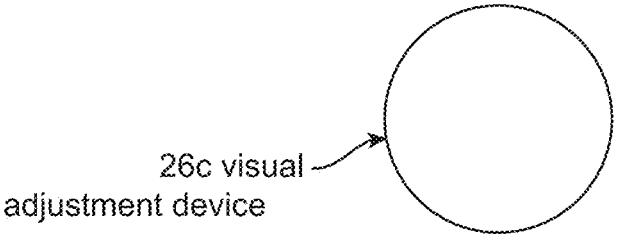

As shown in FIGS. 2-4, the visual adjustment device may define a cone-shape. As illustrated in the top-down view in FIG. 5*a*, the cone-shape may radially extend at least 90-degrees around a perimeter of the camera 22 so that the camera 22 captures images at least 90-degrees around a perimeter of the housing 12 along a second direction Y that is perpendicular to the first direction X. As shown in FIG. 5*b*, the cone-shape may radially extend at least 180-degrees around a perimeter of the camera 22 so that the camera 22 captures images at least 180-degrees around a perimeter of the housing 12 along the second direction Y. Even still, as illustrated in FIG. 5*c*, the cone-shape may radially extend 360-degrees around a perimeter of the camera 22 so that the camera 22 captures images 360-degrees around a perimeter of the housing 12 along the second direction Y.

Figure 6:
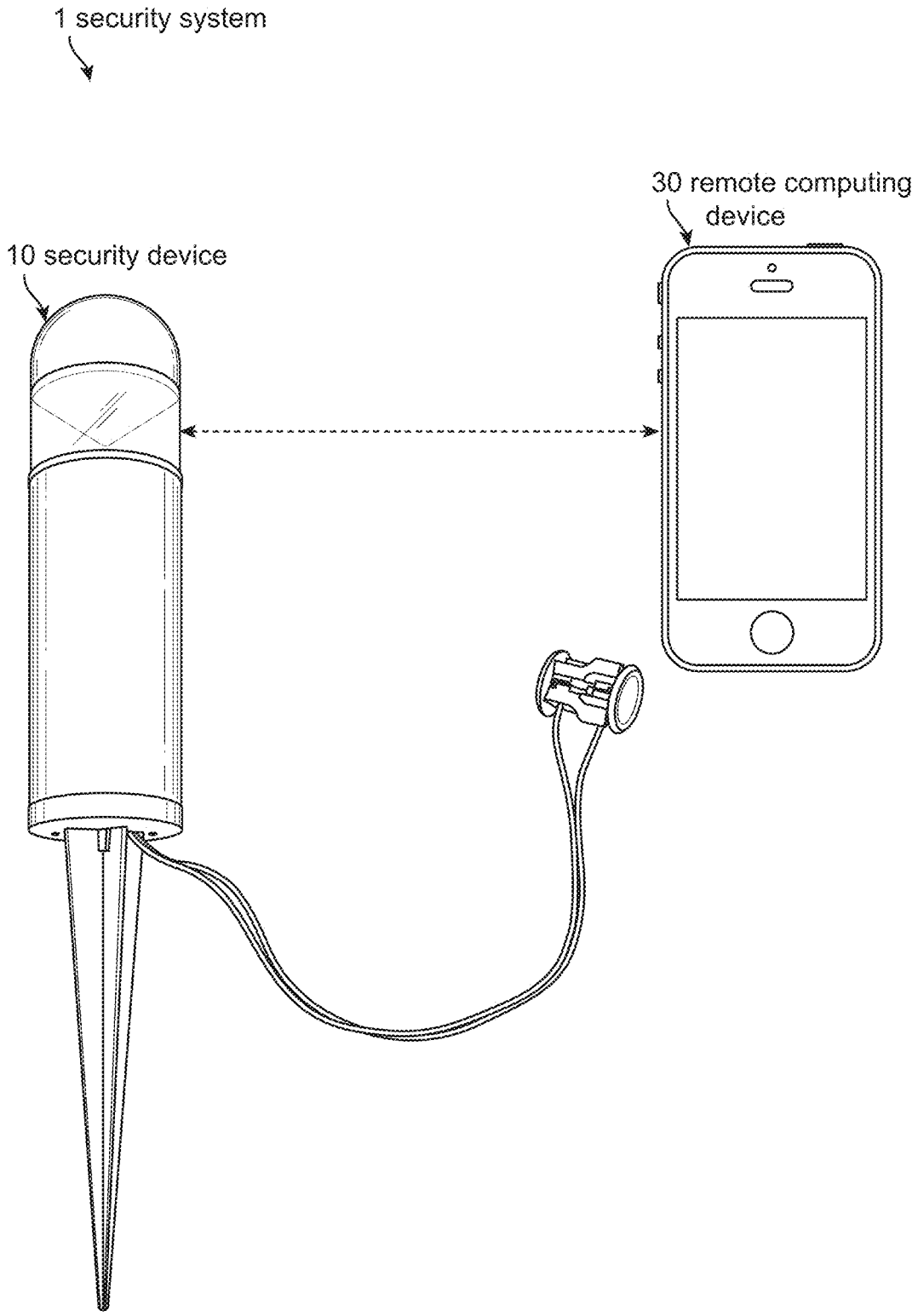
FIG. 6 illustrates a security device and a remote computing device, according to some embodiments.
Figure 7:
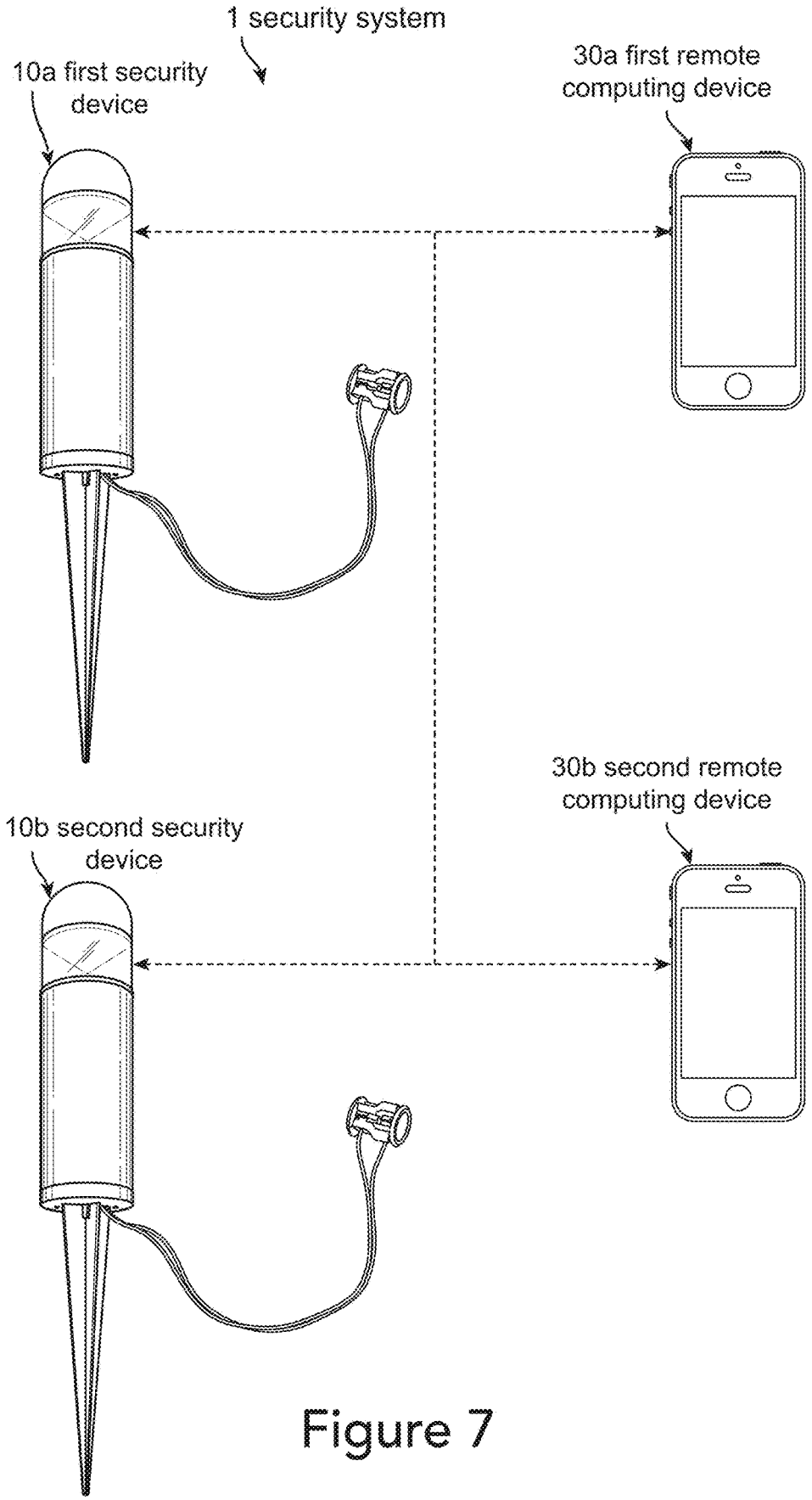
FIG. 7 illustrates first and second security devices and first and second remote computing devices, according to some embodiments.

Now with reference to FIG. 6, the security system 1, may further include a remote computing device 30 communicatively coupled to the security device 10 and/or the camera 22. As shown in FIG. 7, in some embodiments, the system 1 may include first and second weatherproof security devices 10*a*, 10*b* communicatively coupled to first and second weatherproof security device 10*a*, 10*b*. It should be appreciated that any combination of first and second security devices 10*a*, 10*b* may be communicatively coupled to any combination of first and second remote computing devices 30*a*, 30*b*.

As shown in FIGS. 8, 9, 10*a*, and 10*b*, the security device 10 may include a microphone 54 coupled to the housing 12 and a speaker 56 coupled to the housing 12. The microphone 54 and speaker 56 may be arranged and configured to enable two-way communication between the security device 10 and the remote computing device 30.

Figure 10A:
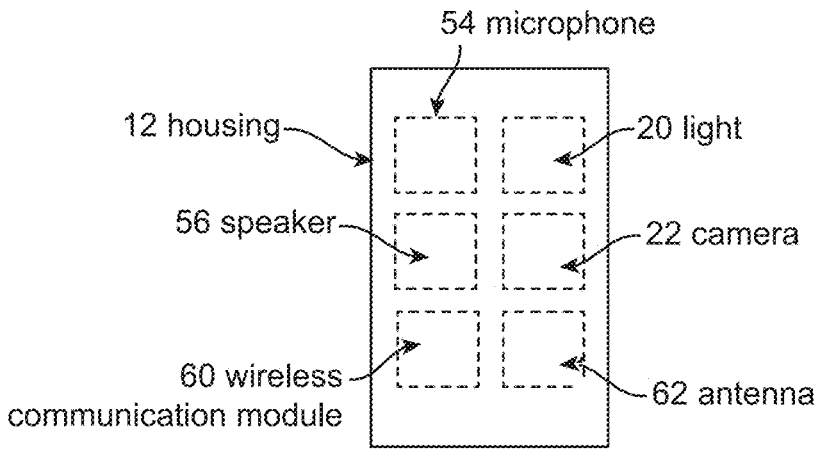
FIGS. 10*a* and 10*b* illustrate housings of various security devices, according to some embodiments.
Figure 10B:
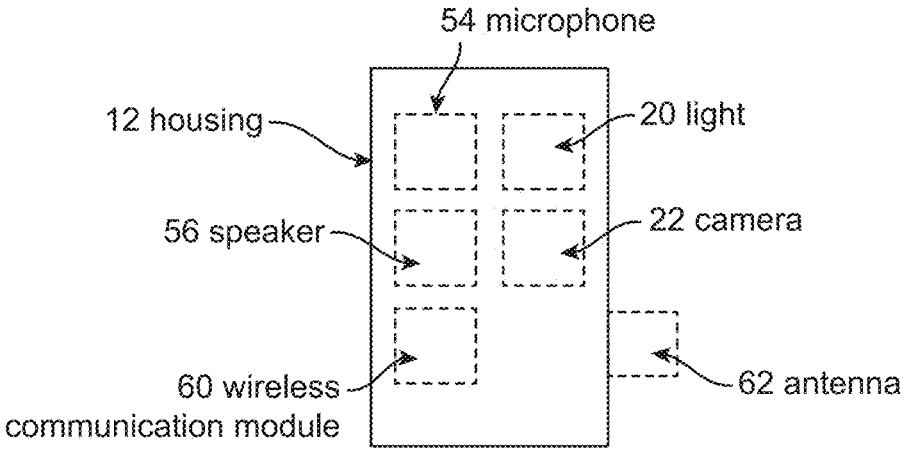

To enable communication between the security device 10 and other devices, such as remote computing devices 30, the security device 10 may comprise a wireless communication module 60 coupled to the housing 12. In some embodiments, the wireless communication module 60 comprises at least one of a Wi-Fi extender, Wi-Fi booster, and Wi-Fi repeater. The security device 10 may also include an antenna 62 communicatively coupled to the wireless communication module 60. As illustrated in FIG. 10*a*, the antenna 62 may be located within the hollow inner portion 17 of the housing 12. Even still, as shown in FIG. 10*b*, the antenna 62 may be coupled to an outer surface of the housing 12.

The security device 10 may be powered by a low voltage power supply transmitted through a low voltage electrical cable and plug 41 extending from the housing 12. Accordingly, any of the components, such as the light 20 and/or camera 22 may be coupled to the housing 12 via a low voltage electrical connection 40, whereby the light 20 and/or camera 22 may receive electrical power from the low voltage electrical connection 40.

Figure 8:
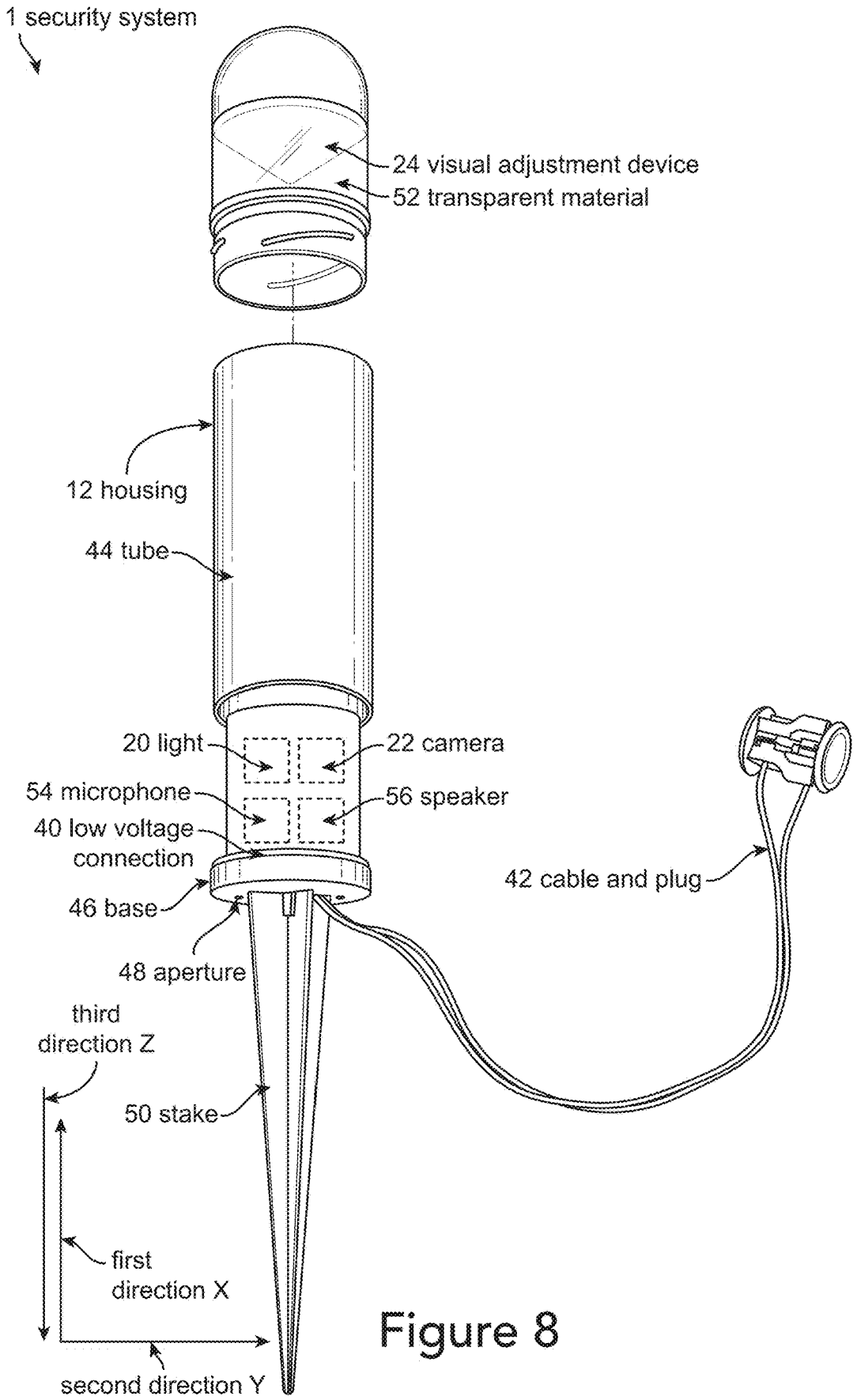
FIG. 8 illustrates an exploded view of a security device, according to some embodiments.
Figure 9:
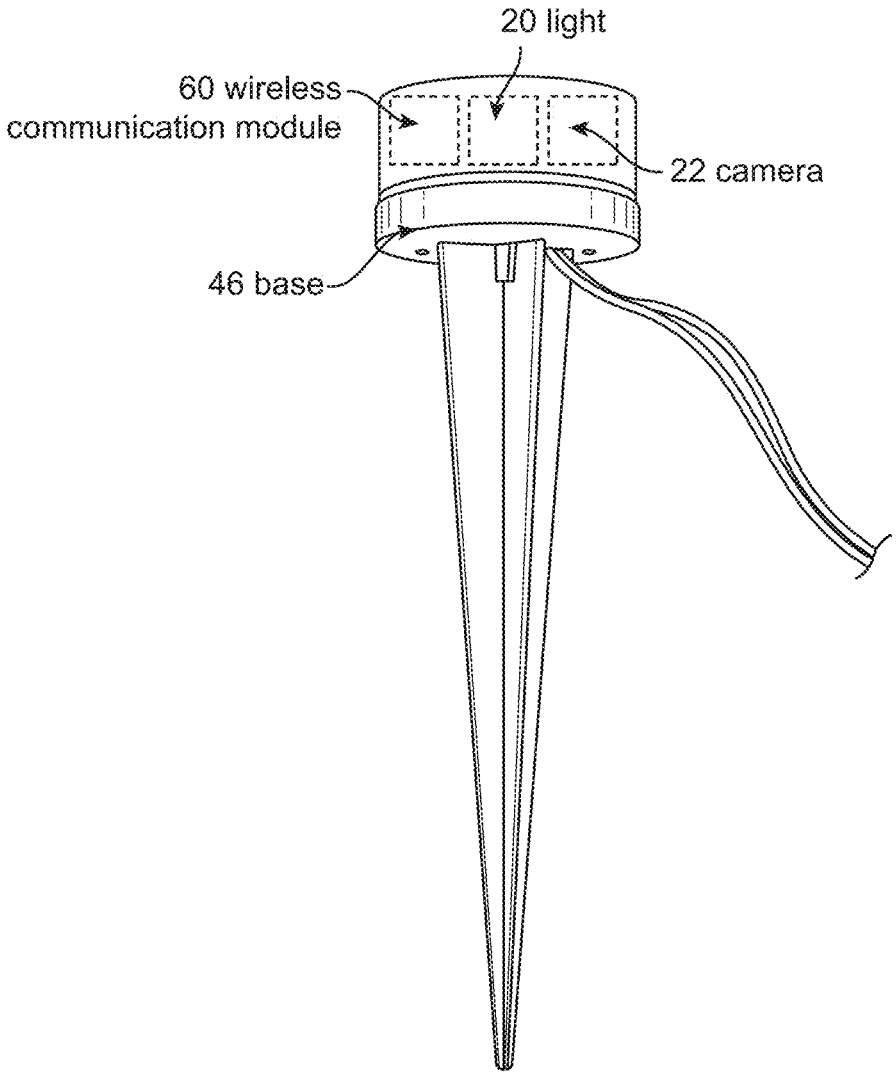
FIG. 9 illustrates a base of a security device, according to some embodiments.

As illustrated in FIG. 8, the housing 12 may include a tube 44 elongate along the first direction X and a base 46 coupled to the elongate tube 44. In some embodiments, the base 46 is rotatably coupled to the tube 44. Even still, in some embodiments, the base 46 further comprises at least one aperture 48 extending through the base 46 such that moisture is able to escape the hollow inner portion 17 of the housing 12. As well, the security device 10 may include a stake 50 extending from the base along a third direction Z opposite the first direction X.

The various components of the security device 10 may be coupled together via a variety of coupling mechanisms. For example, the visual adjustment device 24 may be rotatably coupled to the housing 12. As well, the camera 22 and light 20 may be slideably coupled to the housing 12, such as via a low voltage electrical connection (e.g. two electrical prongs).

With continued reference to FIG. 8, the security device 10 may further include a transparent material 52 (e.g., substantially clear portion) that radially extends around the visual adjustment device 24. In some embodiments, the transparent material 52 is glass, plastic, polycarbonate, and/or acrylic.

It should be appreciated that the security device 10 may be implemented with any combination of components. In some embodiments, the security device 10 comprises a housing 12, a camera 22 coupled to the housing 12, and a low voltage electrical connection 40 coupled to the housing 12 and electrically coupled to the camera 22. Some embodiments may also include the wireless communication module 60 coupled to the housing 12 and communicatively coupled to the camera 22. In this regard, the wireless communication module 60 is arranged and configured to transmit images captured by the camera 22 to the remote computing device 30.

In some embodiments, the security device 10 is referred to as a wireless communication system that includes a weatherproof housing 12, a Wi-Fi extender 60 coupled to the weatherproof housing 12, and a low voltage electrical connection 40 coupled to the weatherproof housing 12 and electrically coupled to the Wi-Fi extender 60. In such embodiments, the wireless communication system may further include an antenna 62 communicatively coupled to the Wi-Fi extender 60.

The security device 10 may also include different types of low voltage electrical connections. In some embodiments, the low voltage electrical connection 40 comprises a male connection configured to electrically couple to a low voltage female connection. Alternatively, the low voltage electrical connection 40 comprises a female connection configured to electrically couple to a low voltage male connection. Accordingly, the components (e.g. light 20, camera 22, etc.) may be electrically coupled to the security device 10 via the opposite connection type. For example, if the security device 10 includes a female connection, then the light 20 may include a male connection.

Figure 11:
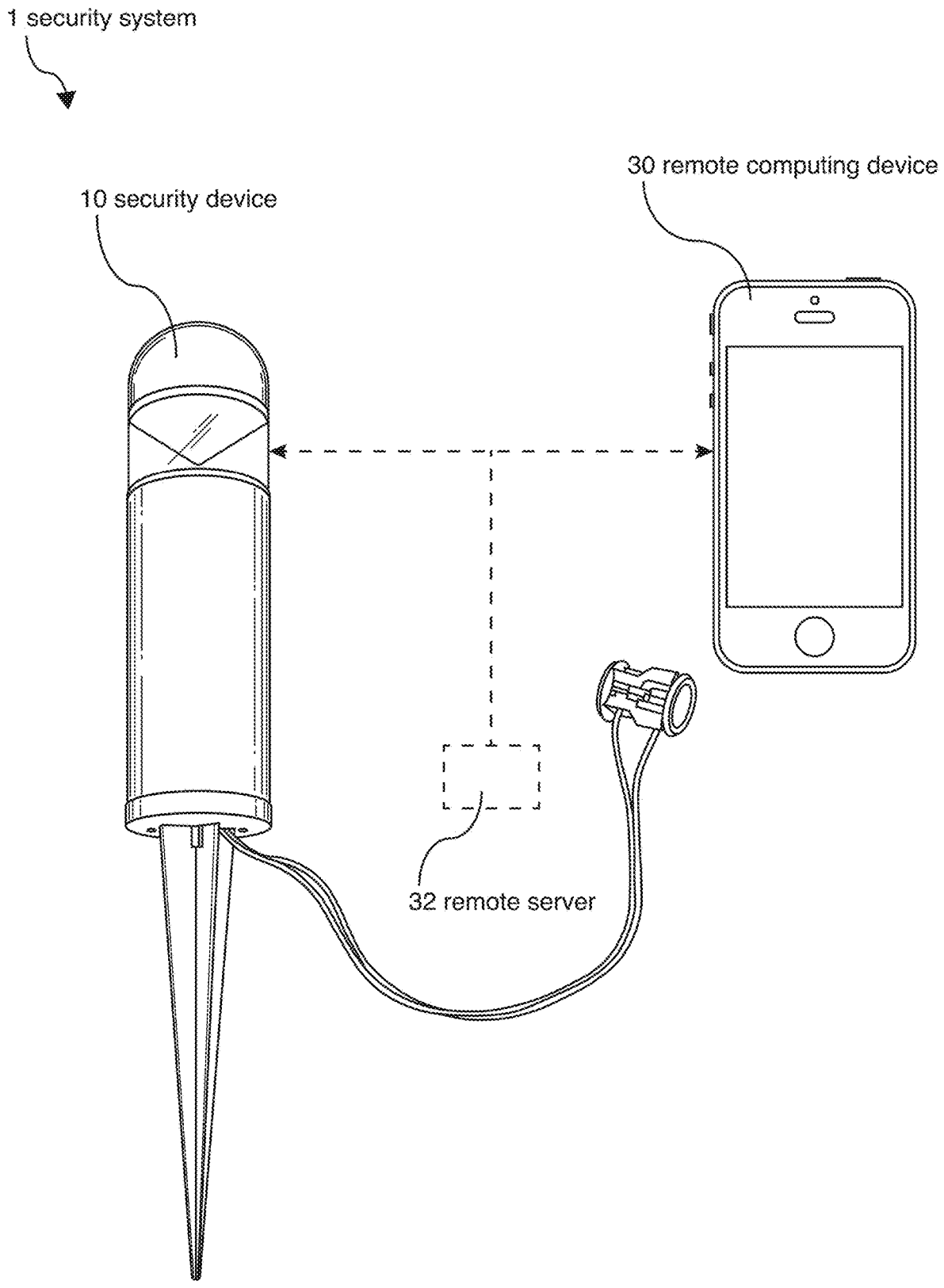
FIGS. 11, 12, 13, and 14 illustrate various communication configurations, according to some embodiments.

As shown in FIGS. 11-14, the security system 1 may be configured in a variety of scenarios to ultimately communicatively couple the security device 10 to the remote computing device 30. With reference to FIG. 11, the system 1 may be configured such that the security device 10 is communicatively coupled to a remote server 32 (or a plurality of remote servers 32), which is thereby communicatively coupled to the remote computing device 30. In this regard, the security device 10 is indirectly communicatively coupled to the remote computing device 30, via the remote server 32.

Accordingly, the system 1 may also include the remote computing device 30 communicatively coupled to least one of the light 20, the camera 22, the at least one directional microphone 55, and the remote server 32. The remote computing device 30 may be configured to receive an alert in response to the security system 1 detecting the presence of the person. More specifically, the remote computing device 30 may be configured to receive an alert in response to the at least one directional microphone 55 receiving the detected sound and/or the motion detector 28 detecting a motion. The alert may comprise an image captured by the camera 22.

Figure 12:
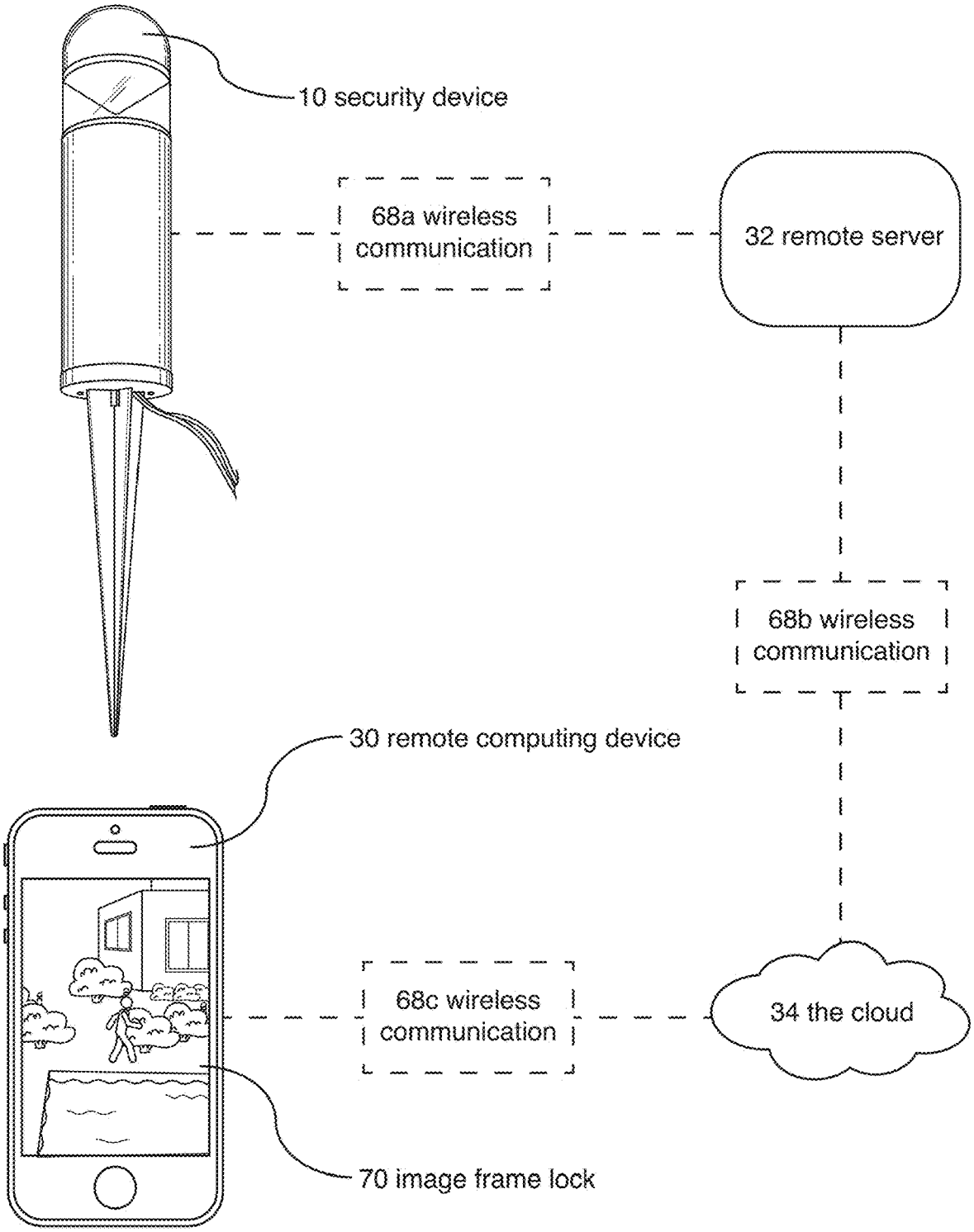

FIG. 12 illustrates a communication configuration whereby the security device 10 is communicatively coupled to the remote computing device 30, via the remote server 32 and the cloud 34. In this regard, the security device 10 is communicatively coupled to the remote server 32, which is communicatively coupled to the cloud 34, which is ultimately communicatively coupled to the remote computing device 30. Stated differently, the security device 10 is indirectly communicatively coupled to the remote computing device 30, via the remote server 32 and the cloud 34. As shown in FIG. 12, various wireless communications 68*a*, 68*b*, 68*c* may be transferred between the various communication components, such as the security device 10, remote server 32, cloud 34, and the remote computing device 30. It should be appreciated that the wireless communications 68 may be sent from or to the security device 10. In this regard, if the security device 10 detects a motion or sound, the security device 10 may send wireless communication 68 to the remote computing device 30, via none or at least one of the remote server 32 and the cloud 34. Additionally, the system 1 is designed to enable two-way communication. In this regard, the remote computing device 30 may be able to send a wireless communication 68 to the security device 10, via none or at least one of the remote server 32 and the cloud 34.

Figure 13:
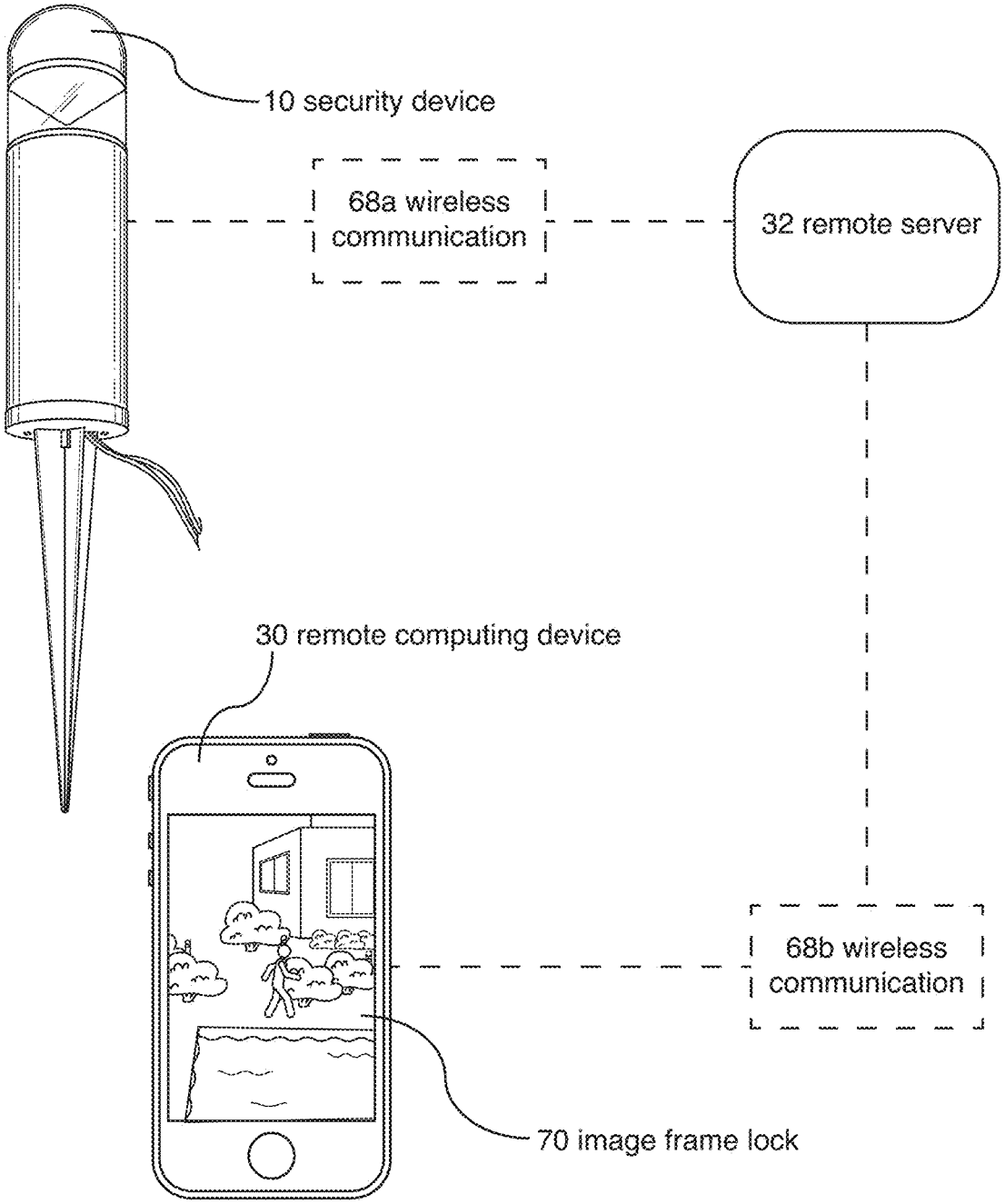
Figure 14:
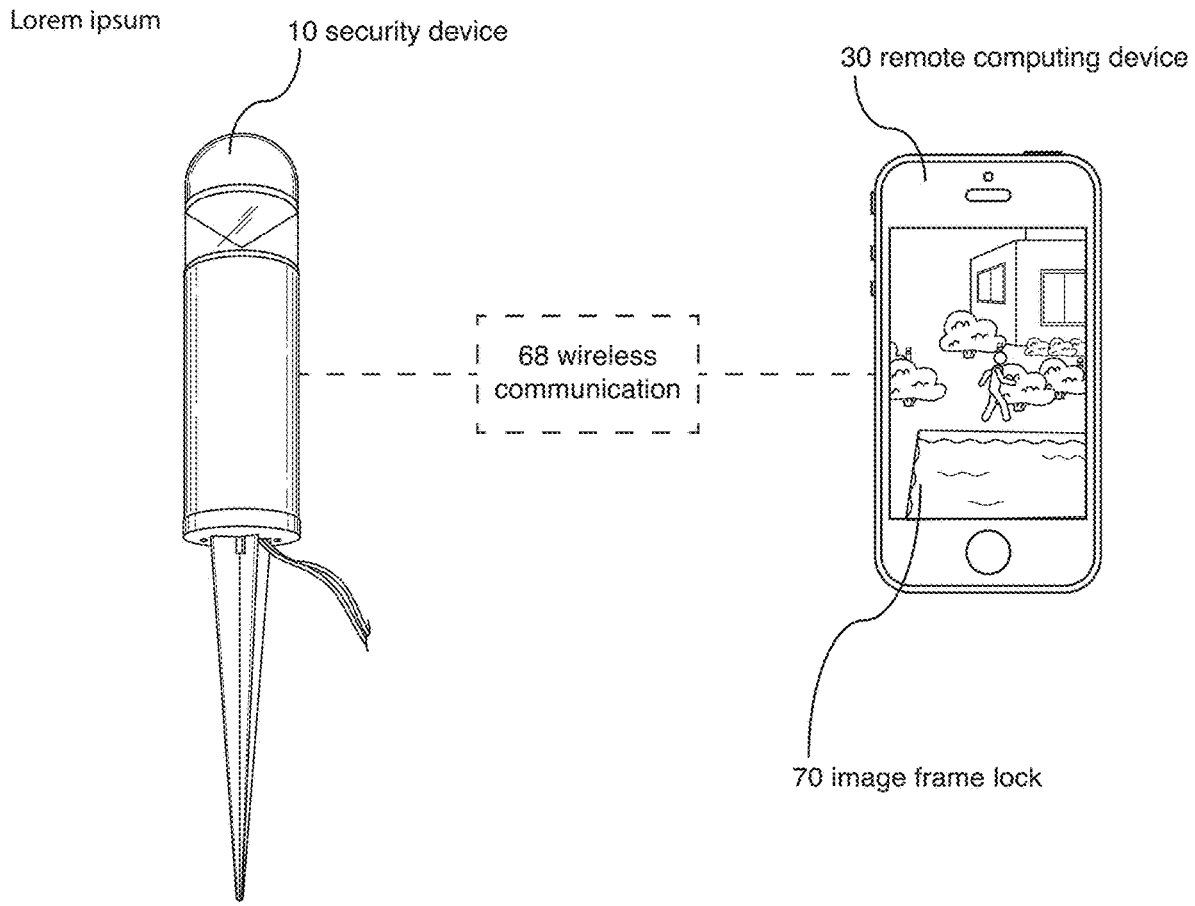

FIG. 13 illustrates an additional communication configuration similar to that of FIG. 11. FIG. 13 shows that wireless communications 68 may be sent from and to the security device 10. As shown in FIG. 14, system 1 may be configured to enable peer-to-peer communications whereby the security device 10 is communicatively coupled directly to the remote computing device 30.

Figure 15:
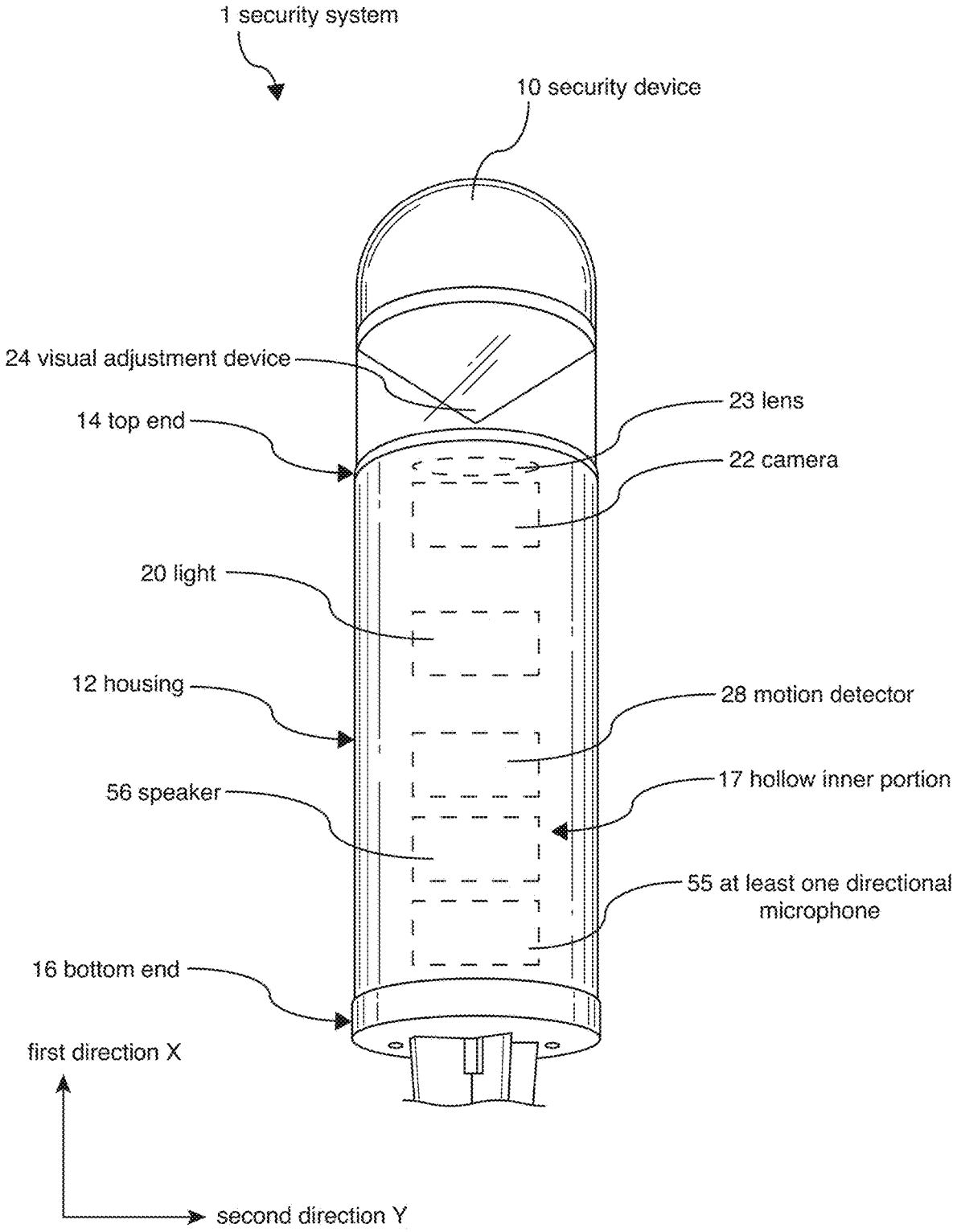
FIGS. 15, 16, 17, and 18*a* illustrate partial views of various security devices, according to some embodiments.

As shown in FIG. 15, the security system 1 includes an outdoor security device 10 comprising a housing 12 elongate along a first direction X. The housing 12 comprises a top end 14, a bottom end 16 located opposite the top end 14, and a hollow inner portion 17. The security device 10 may include a light 20 coupled to the housing 12 and located within the hollow inner portion 17. The security device 10 may also include a camera 22 and a lens 23 coupled to the housing 12. In some embodiments, the lens 23 is located between the camera 22 and the top end 14 such that the camera 22 is configured to capture images around a perimeter of the outdoor security device 10. In some embodiments, the security device 10 includes at least one directional microphone 55 communicatively coupled to the camera 22 and configured to determine a location of a detected sound whereby the camera 22 performs a frame lock 70 to capture an image associated with the detected sound. The system 1 may also include additional components, such as a visual adjustment device 24, a light 20, a motion detector 28, and a speaker 56, which will be discussed in more detail later.

Figure 16:
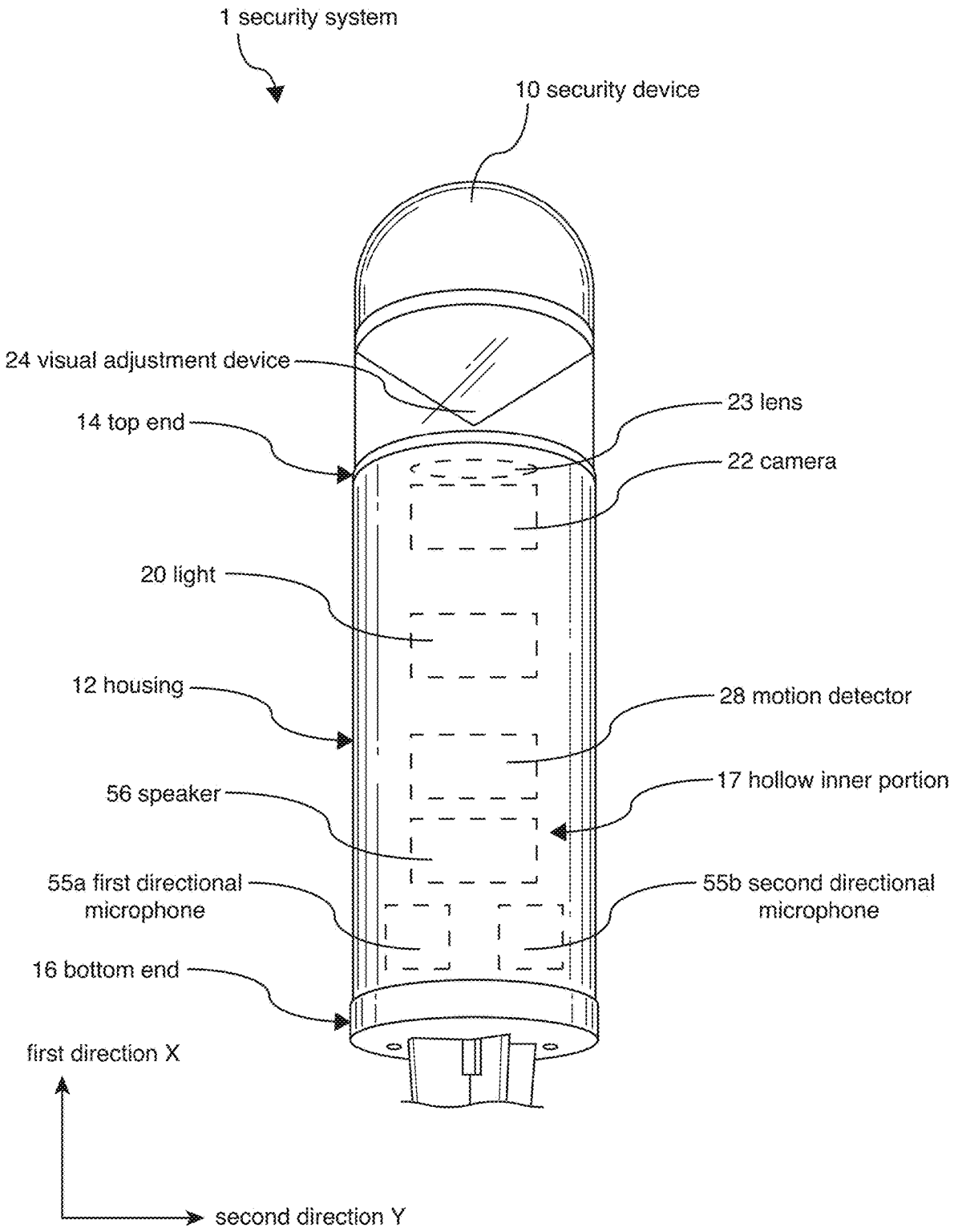
Figure 17:
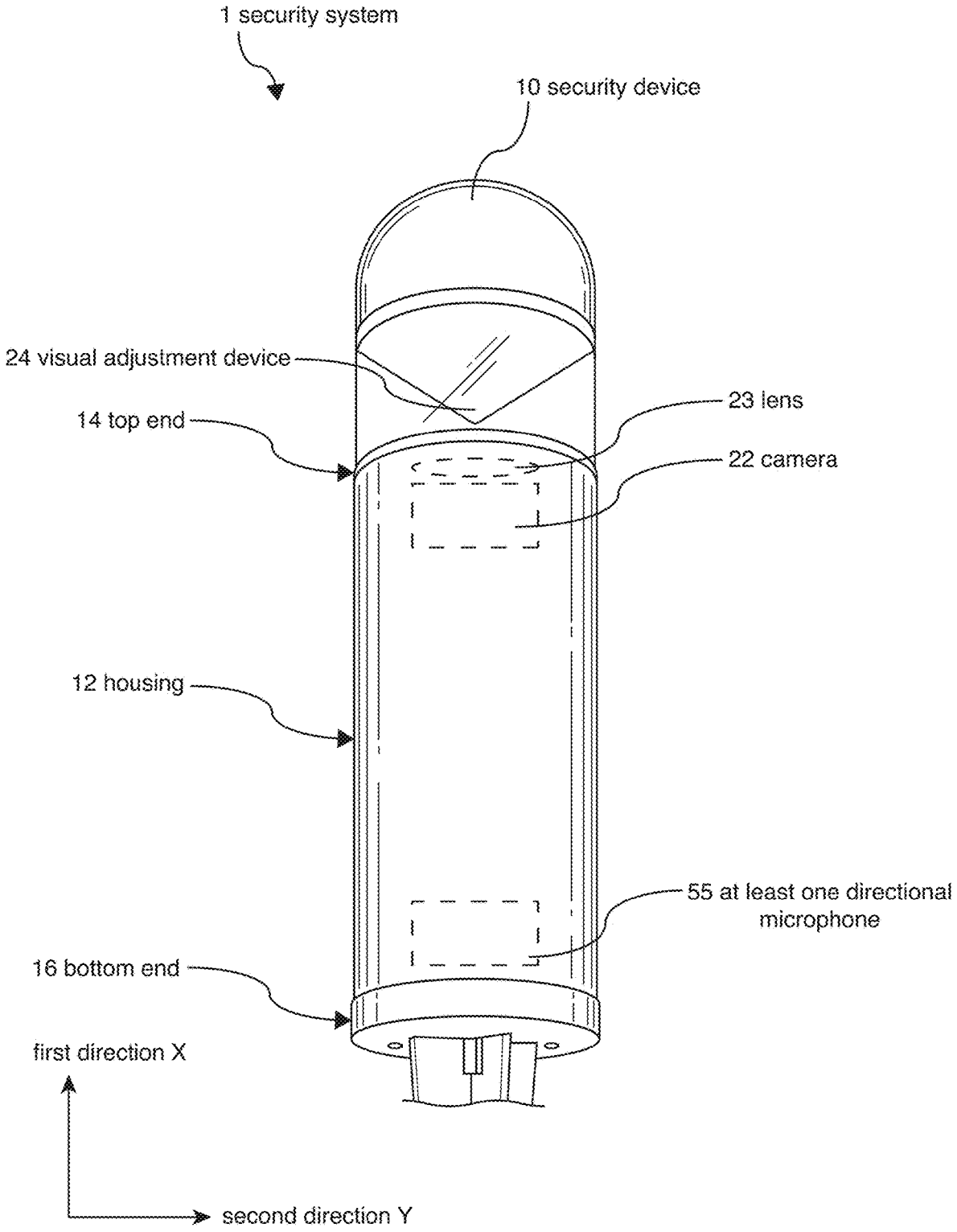

As illustrated in FIGS. 15, 16, and 17, the system 1 may be implemented with one directional microphone or a plurality of directional microphones. Additionally, the at least one directional microphone 55, 55*a*, 55*b* may be positioned in any location on or inside the security device 10, such as inside the top end 14, inside the bottom end 16, any location within the hollow inner portion 17*b*, embedded within the housing 12, or any place along an outer surface of the security device 10 or housing 12. Furthermore, for multiple directional microphone embodiments, the microphones 55*a* and 55*b* may be arranged with respect to each other. As shown in FIG. 16, the first directional microphone 55*a* and the second directional microphone 55*b* may be located on opposite sides of the housing 12. In some embodiments, the first directional microphone 55*a* and the second directional microphone 55*b* are coupled at about the same vertical location on the housing 12.

FIG. 16 shows that the security device 10 may also include a speaker 56 coupled to the housing and communicatively coupled to at least one of the light 20, the camera 22, and the at least one directional microphone 55. The speaker 56 may be configured to enable two-way communication between the security device 10 and the remote computing device 30. Moreover, the speaker can be configured to emit various sounds in response to the system 1 detecting the presence of an intruder. For example, if an intruder enters a swimming pool located within the field of view 64 of the security device 10, the speaker 56 may emit a warning message, such as "Please exit the pool immediately. The homeowner and the authorities have been notified!"

Figure 18A:
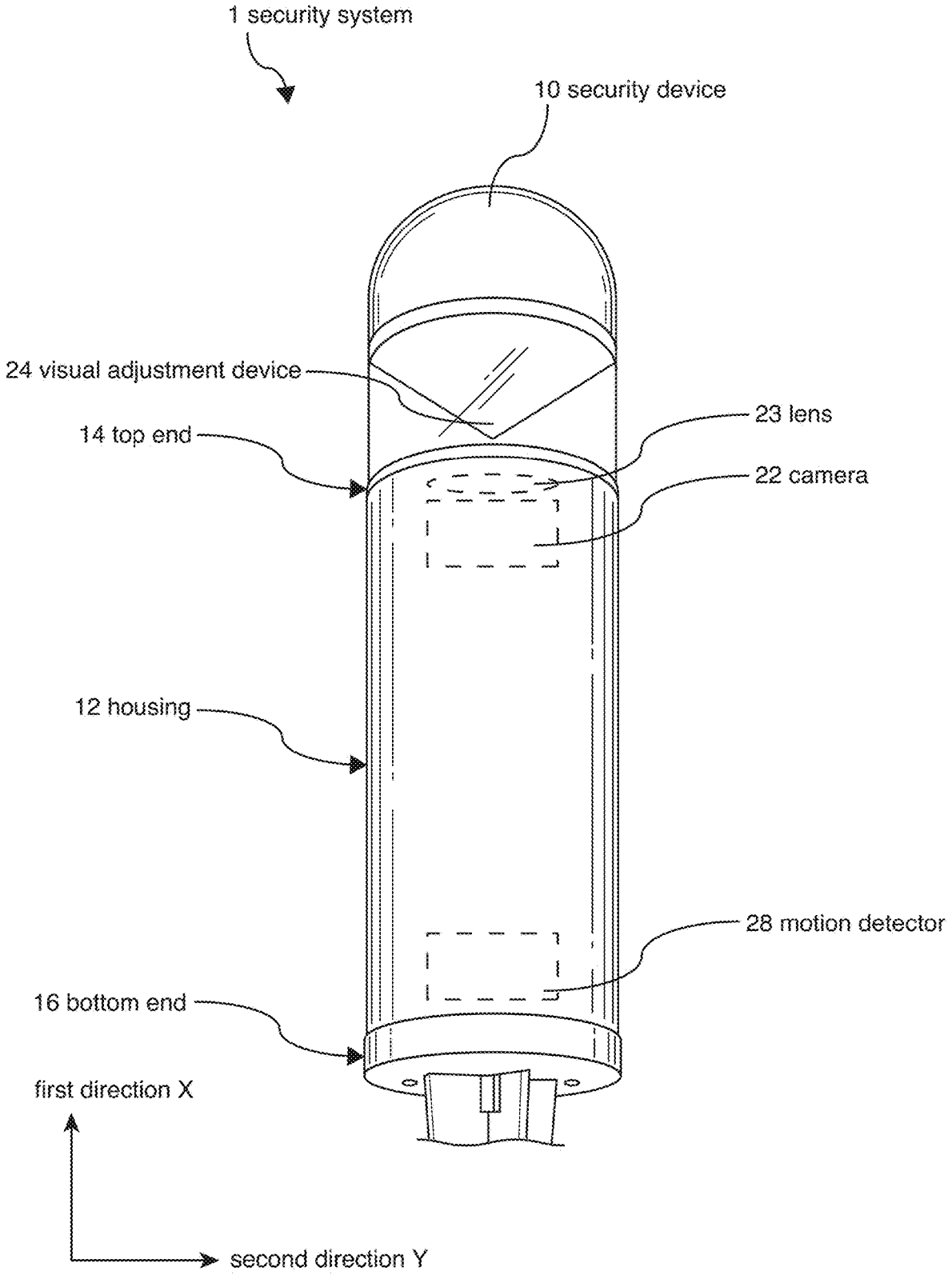

As shown in FIG. 18*a*, the system 1 may also include a motion detector 28 communicatively coupled to the camera 22. The motion detector 28 may thereby be configured to determine the location of a motion whereby the camera 22 performs a frame lock 70 on a location of the motion to capture an image associated with the motion. The motion detector 28 may comprise a passive infrared sensor (PIR), ultrasonic sensor, microwave sensor, tomographic sensor and any combination of sensor types. Additionally, the system 1 may be implemented with at least one directional microphone 55, or a motion detector 28, or both.

Any of the components described throughout this disclosure, such as the at least one directional microphone 55 and/or the motion detector 28, may be implemented as one or more remote sensors. In this regard, the at least one directional microphone 55 may be one or more directional microphones located remotely with respect to the security device 10. Additionally, the motion detector 28 may be located remotely with respect to the security device 10. Accordingly, any of the remote sensors may be communicatively coupled to the security device 10 via a wireless or wired connection. The remote sensors may receive power from a power source that is separate from the security device 10 or receive power directly from the security device 10.

Figure 18B:
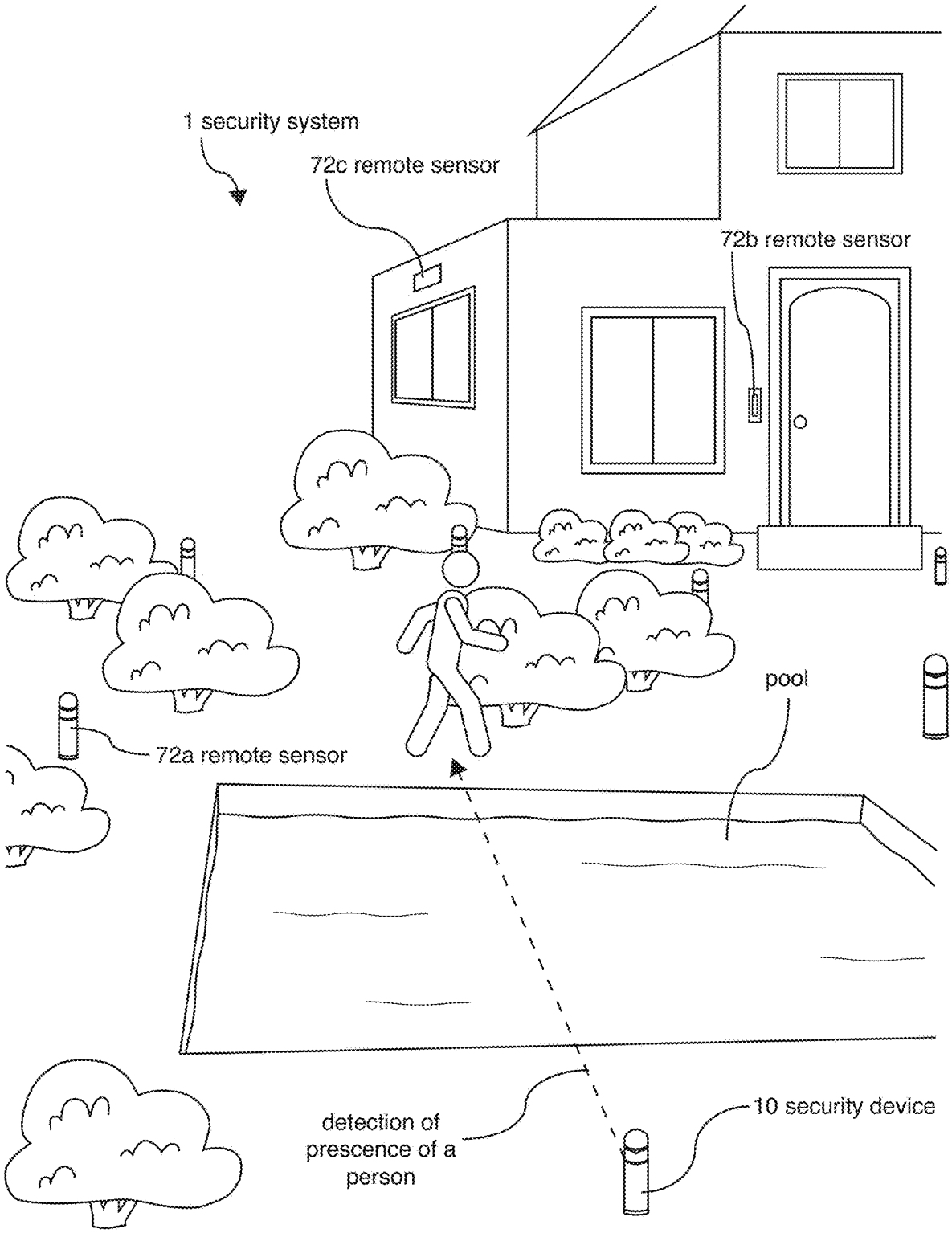
FIG. 18*b* illustrates a security device and one or more remote sensors in an environment of use, according to some embodiments.

Now with reference to FIG. 18*b*, the security device 10 may be communicatively coupled to any variety of remote sensors that detect activity around the security device 10. In response to the remote sensor(s) 72 detecting the activity, the security device 10 may perform any of the features described throughout this disclosure, including performing the frame lock and sending and/or receiving a wireless communication (e.g., an alert) to/from the remote computing device 30. In some embodiments, the system 1 includes a first remote sensor 72*a* (e.g., a connected yard light, including another security device 10), a second remote sensor 72*b* (e.g., an electronic doorbell, including a smart doorbell), and a third remote sensor 72*c* (e.g., a connected house light, including a motion detecting light source).

Figure 19:
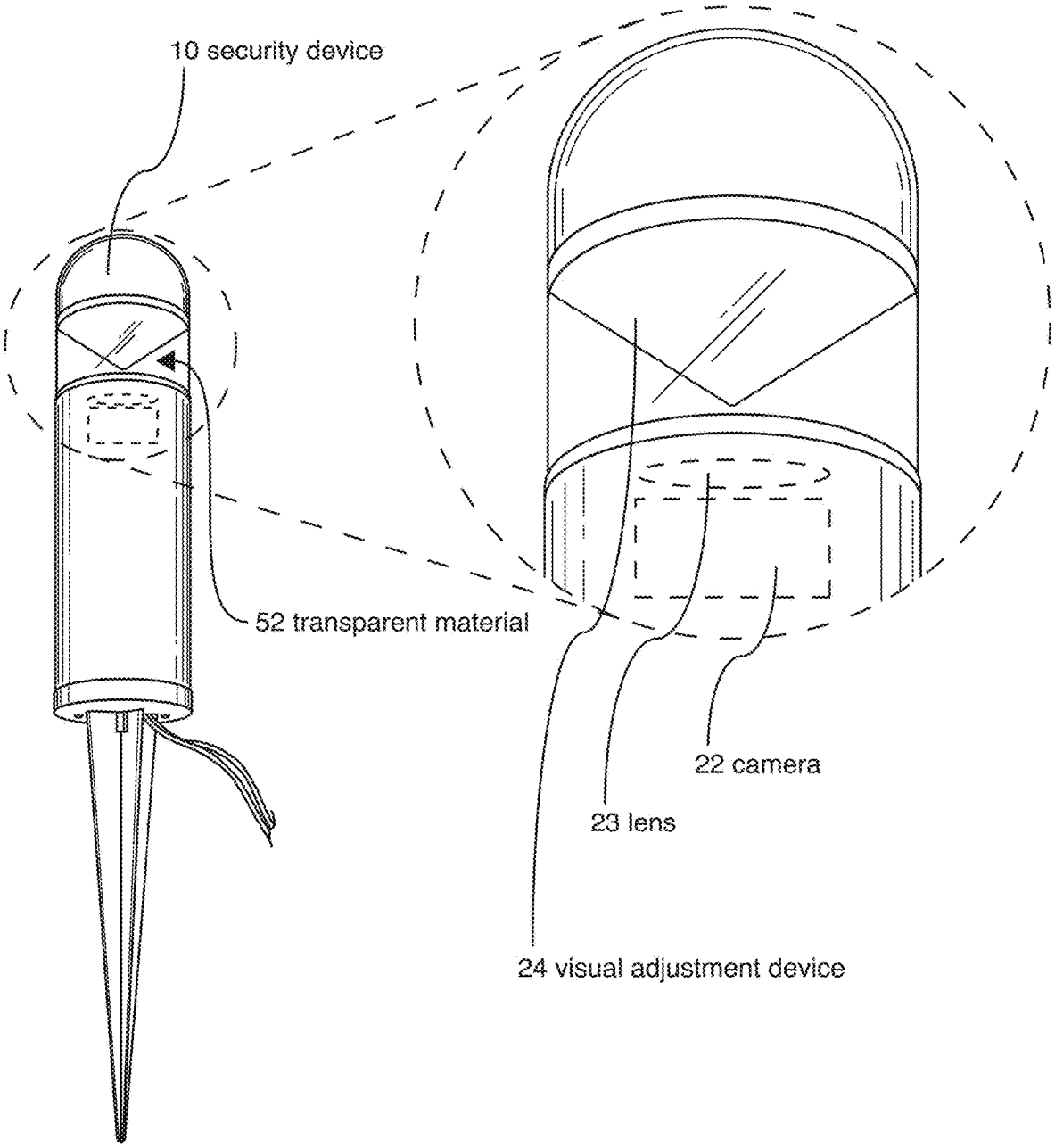
FIG. 19 illustrates a security device and a close-up view of a camera and lens, according to some embodiments.

FIG. 19 illustrates embodiments whereby the system 1 includes a visual adjustment device 24 configured to allow the camera 22 to see the periphery of the security device 10. In such embodiments, the system 1 may include the camera and a lens 23, such as a flat lens, aimed at the visual adjustment device 24 and configured to enable the camera 22 to visually and clearly detect images reflected by the visual adjustment device 24. Stated differently, the visual adjustment device 24 may thereby be aligned with the lens 23 and the camera 22 such that the visual adjustment device is configured to allow the camera to capture images around the perimeter of the outdoor security device 10. As shown, the visual adjustment device 24 may be coupled to the housing 12 and located along the hollow inner portion 17 of the housing 12 adjacent the top end 14. The visual adjustment device 24 may comprise a cone-shaped mirror having a tip facing towards the camera 22 and the lens 23.

Figure 20:
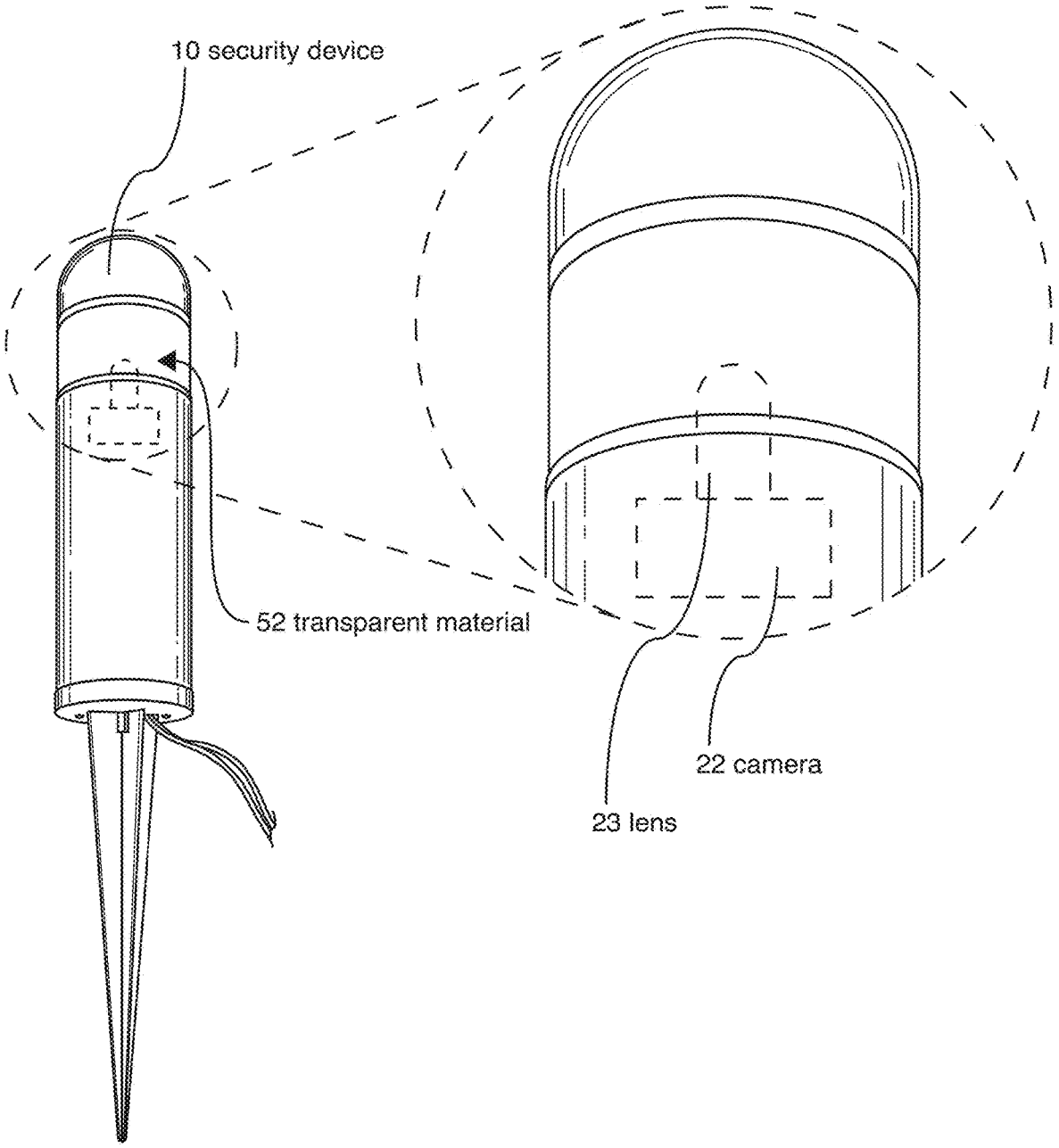
FIG. 20 illustrates another security device and a close-up view of a camera and lens, according to some embodiments.

The security device 10 may also include a transparent material 52 coupled to the housing and located adjacent the top end. As shown in FIGS. 19 and 20, the transparent material 52 is configured to allow the camera 22 to capture images around the perimeter of the outdoor security device 10. The transparent material 52 may comprise a substantially clear portion that is configured to protect the camera 22 and other components from moisture and other outdoor elements that may adversely affect the device 10.

As shown in FIG. 20, the system 1 may also be configured whereby the security device 10 comprises a convex lens 23 configured to allow the camera 22 to capture images around the perimeter of the outdoor security device 10. In some embodiments, the security device 10 may comprise a visual adjustment device 24. However, in some embodiments, the security device 10 may not comprise the visual adjustment device 24, as shown in FIG. 20. As illustrated in FIG. 20, the convex lens may be positioned such that the convex lens has a line of sight through the transparent material 52.

Figure 21:
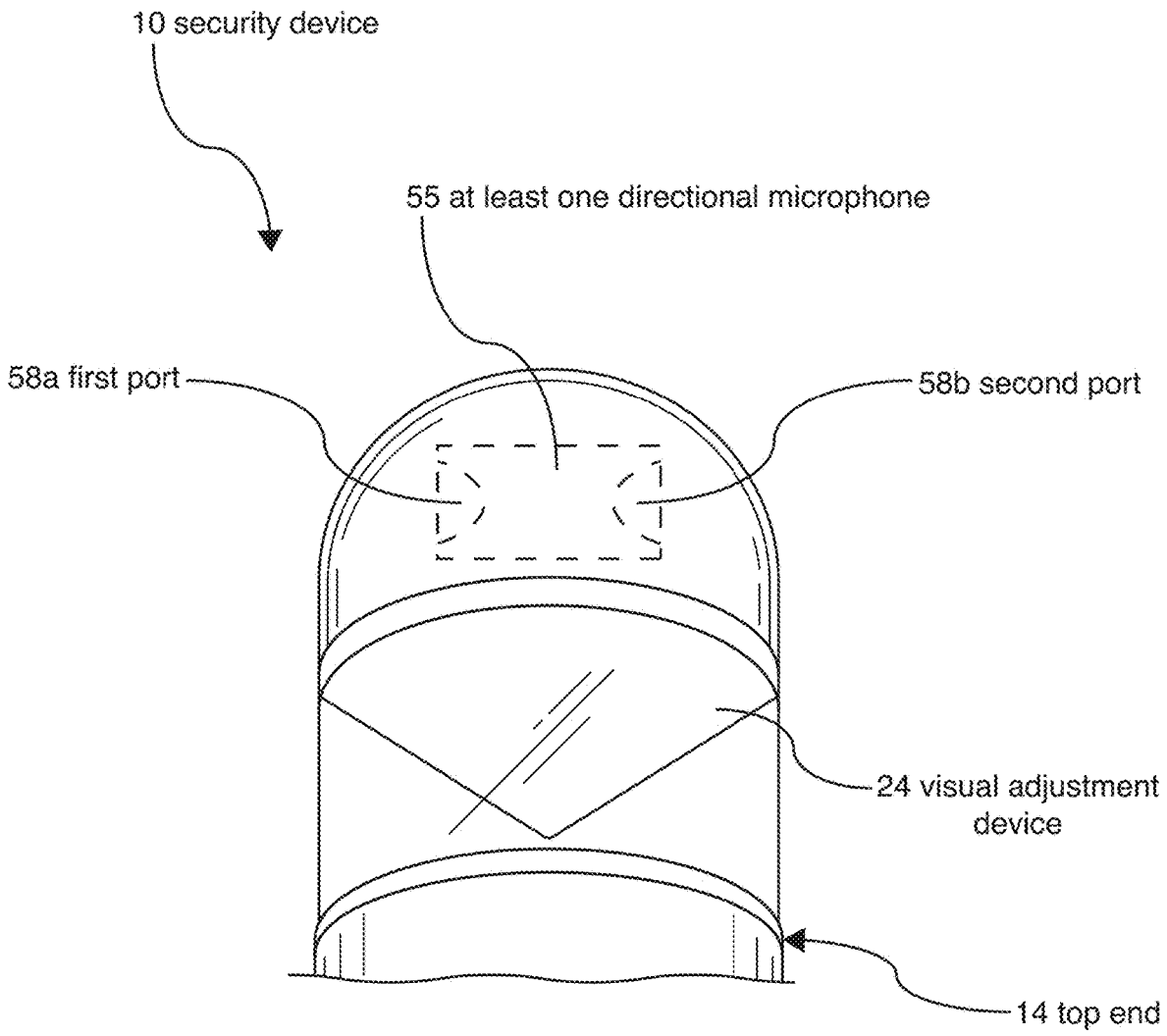
FIG. 21 illustrates a partial view of a security device illustrating a directional microphone having ports, according to some embodiments.

With reference to FIG. 21, the at least one directional microphone 55 may comprise a first port 58*a* and a second port 58*b*. In some embodiments, the at least one directional microphone 55 includes one port, while in other embodiments, the at least one directional microphone 55 includes more than two ports. With respect to FIG. 17, together the first and second ports 58*a*, 58*b* are configured to determine the location of the detected sound. Once the at least one directional microphone 55 detects a sound, the camera 22 may perform a frame lock 70 on the location of the detected sound. Described further, the camera 22 may see the entire periphery of the security device 10 as one image (e.g., a grid, a rectangle, etc.) and in response to a sound or motion, the camera 22 may then focus on the specific location of the sound, as determined by the directional microphone(s) 55. The directional microphone(s) 55, 55*a*, 55*b* may comprise an omnidirectional microphone, a unidirectional microphone, a bidirectional microphone, a cardioid microphone, and the like. Additionally, the camera 22 may also perform the frame lock 70 operation in response to the motion detector 28 detecting a motion and/or a location of the motion.

Figure 22A:
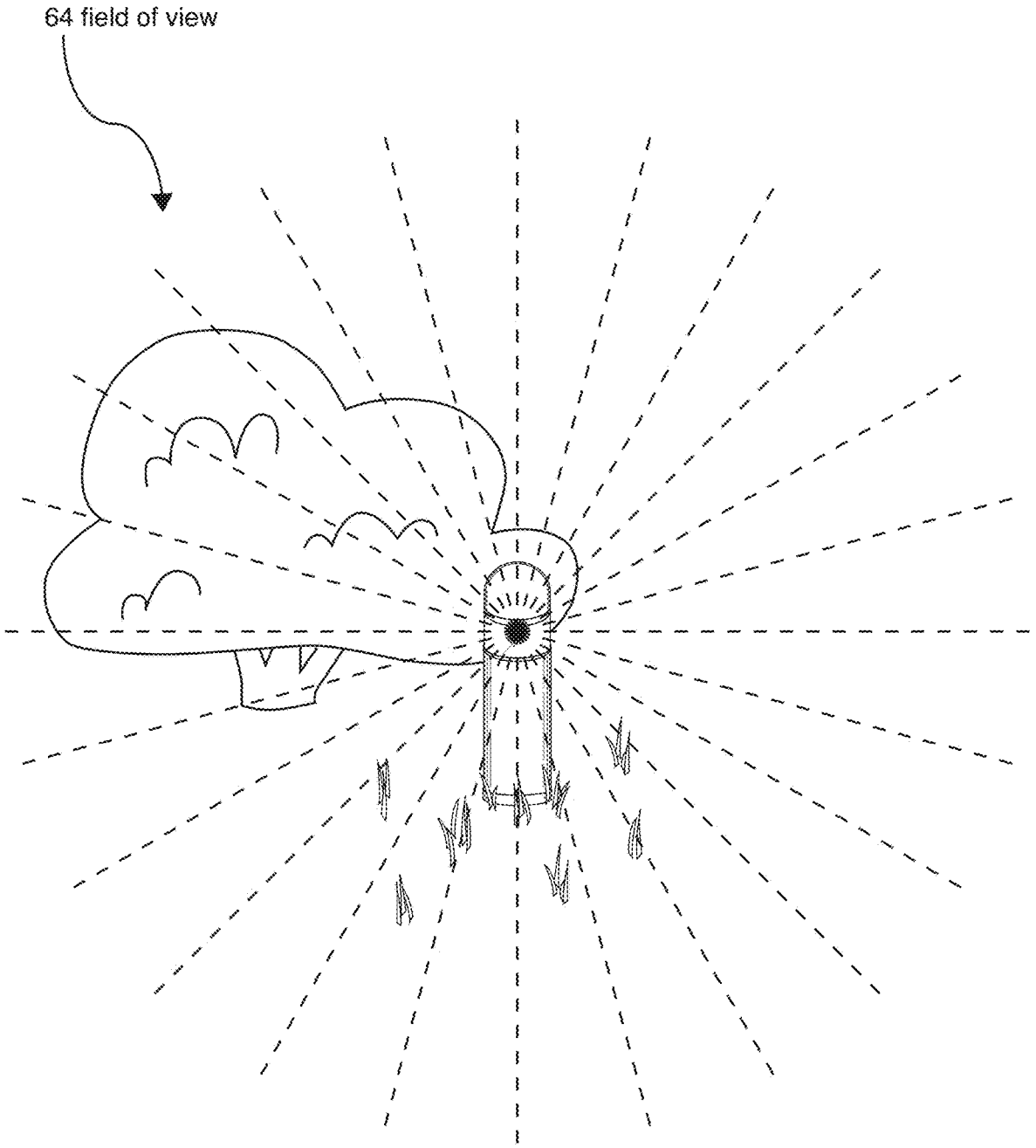
FIGS. 22*a*, 22*b*, 22*c*, and 22*d* illustrate a field of view of a security device, according to some embodiments.

With respect to FIG. 22*a*, regardless of the configuration or lens, the security device 10 may be configured such that the camera 22 captures images from around the outdoor security device 10, referred to as the field of view 64.

Figure 22B:
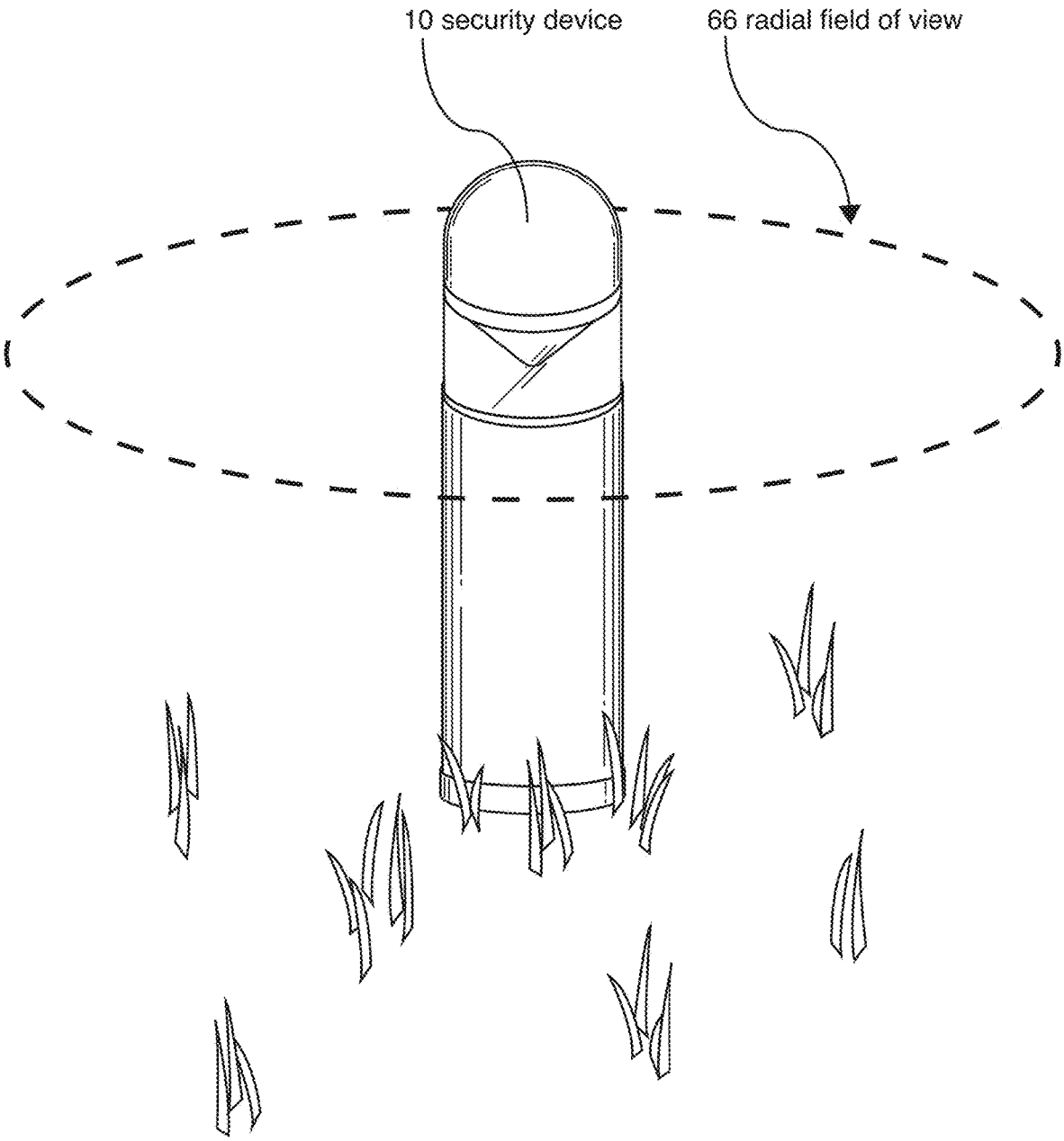
Figure 22C:
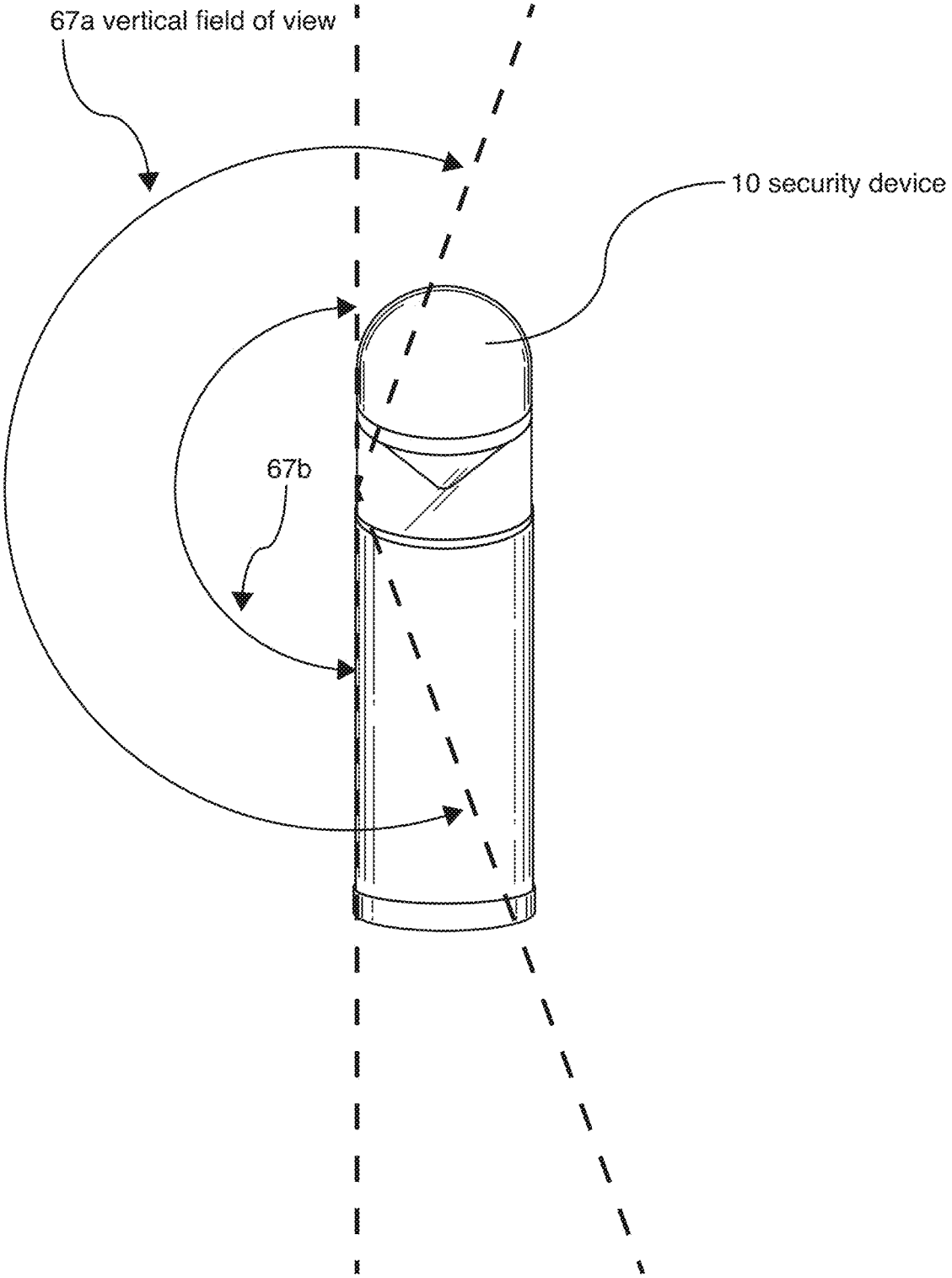

With specific reference to FIGS. 22*b* and 22*c*, the field of view 64 also comprises a radial field of view 66 and a vertical field of view 67. The radial field of view 66 comprises a view of 360-degrees around the outdoor security device 10. The security device 10 can also be configured to capture a radial field of view less than 360-degrees, such as 180-degrees or 90-degrees. In this regard, the radial field of view can be configured to ignore certain zones or portions of the radial perimeter.

As shown in FIG. 22*c*, in some embodiments, the vertical field of view 67 represents a first vertical field of view 67*a* that extends down and back from the side of the security device 10 and covers an entire space that extends up and behind the side of the security device 10. In some embodiments, the first field of view 67*a* is about 220-degrees. The first field of view 67*a* may also be about 190-degrees, 200-degrees, 210-degrees, 230-degrees, any number in between, and the like. Explained differently, it would be the equivalent to a person being able to seeing things above and directly behind them. Explained differently, the first vertical field of view 67*a* would have coverage equivalent to "having eyes in the back of your head."

With continued reference to FIG. 22*c*, in some embodiments, the vertical field of view 67 represents a second vertical field of view 67*b* that extends straight down from the side of the security device 10 and covers an entire space that extends straight up from the side of the security device. In some embodiments, the second vertical field of view 67*b* is about 180-degrees. The second field of view 67*b* may also be about 140-degrees, 150-degrees, 160-degrees, 170-degrees, any number in between, and the like. In this regard, the vertical field of view 67 may be configured to ignore certain zones or portions of the vertical space.

Figure 22D:
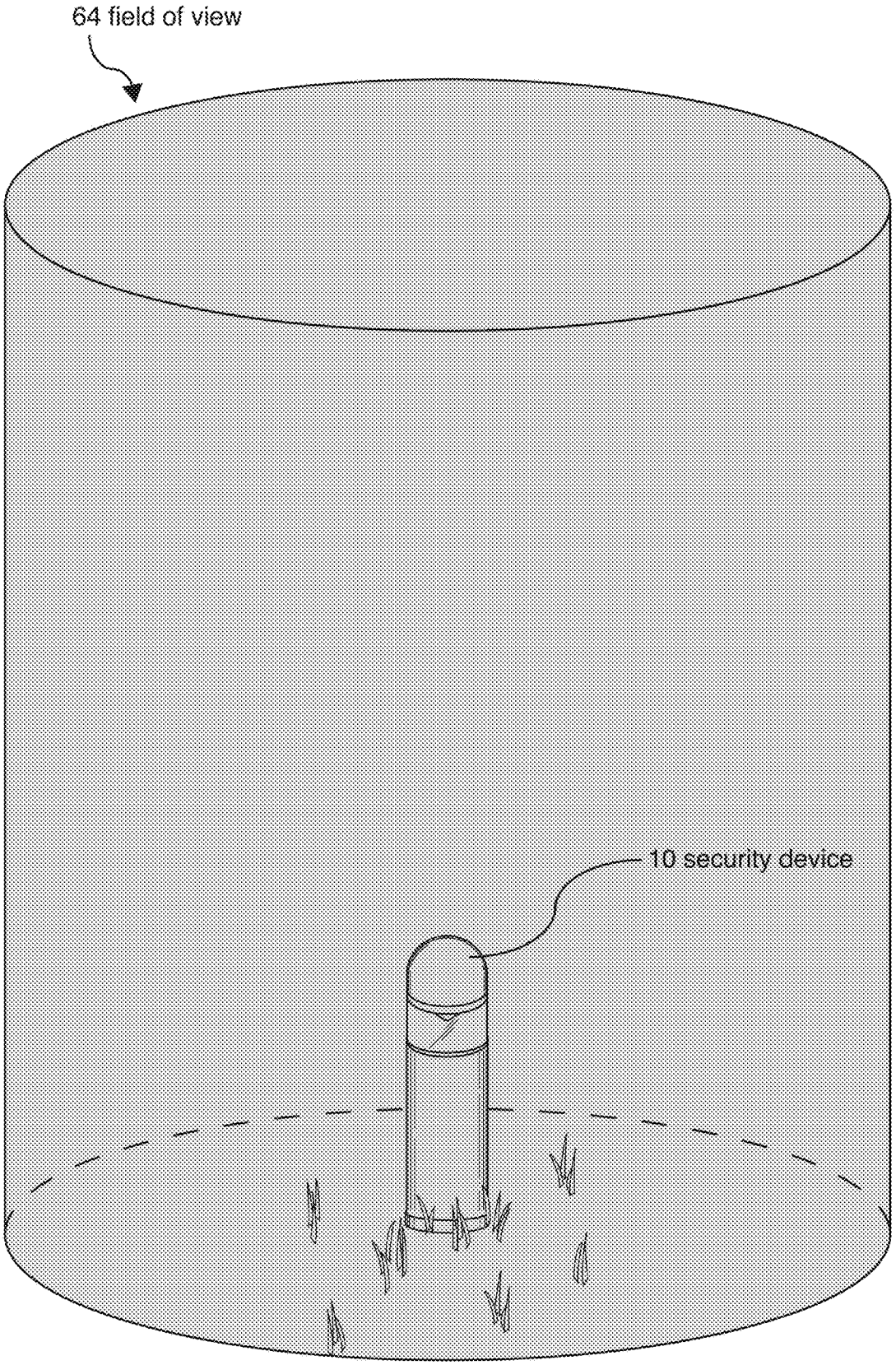

As shown in FIG. 22*d*, the radial and vertical fields of view 66, 67 together provide a comprehensive view above, below, and all around the security device 10, known as the field of view 64. Essentially, the security device 10, via the camera 22, is able to visually capture any event or object occurring within the field of view 64.

Figure 23:
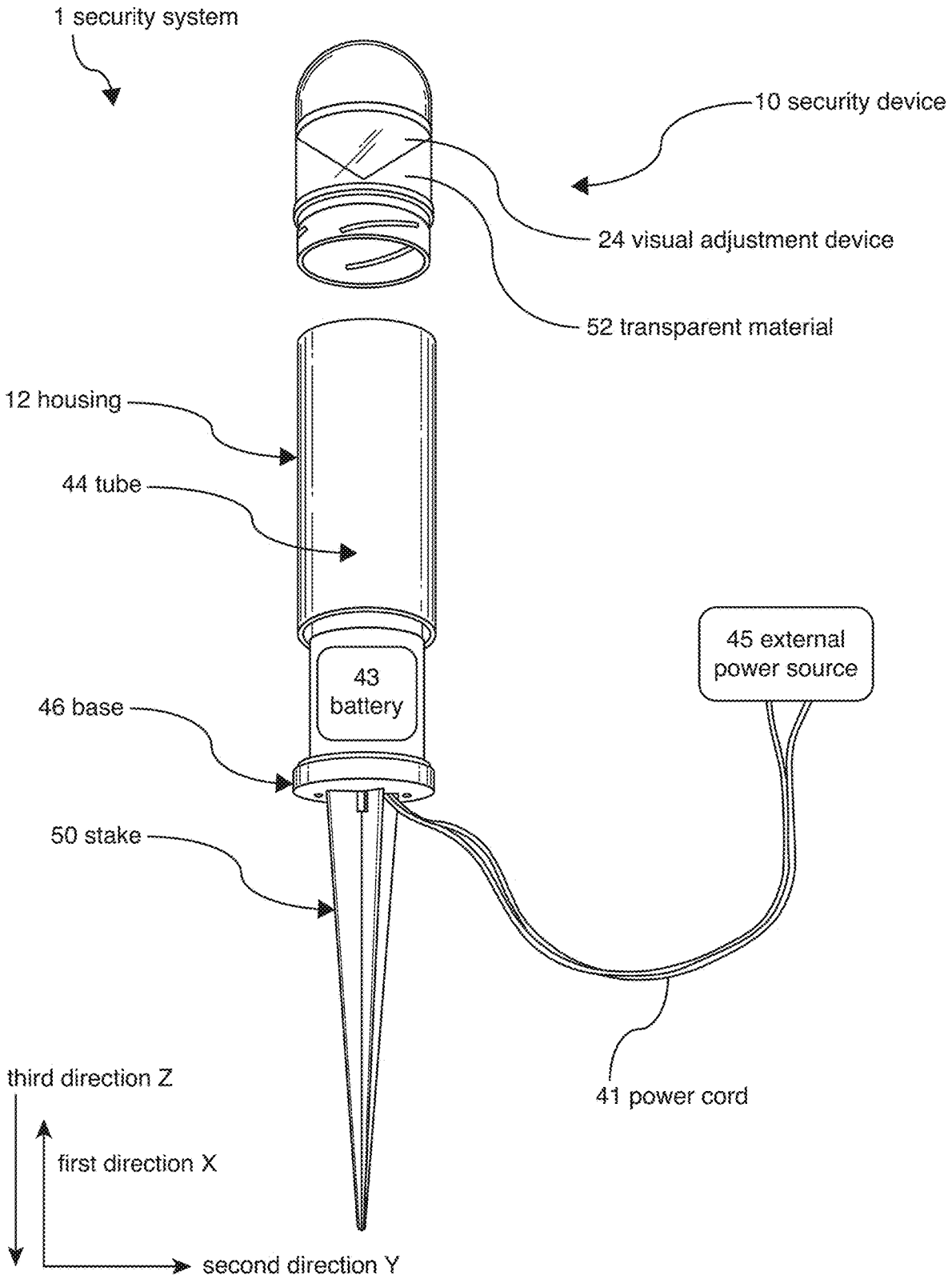
FIG. 23 illustrates an exploded view of a security device having a battery and a power cord electrically coupled to an external power source, according to some embodiments.

Now, with reference to FIG. 23, the security device 10 may comprise a power cord 41 electrically coupled to at least one of the battery 43, the light 20, the camera 22, the least one directional microphone 55, and/or any other electrical component described in this disclosure. In some embodiments, the power cord 41 is configured to receive power from an external power source 45, such as power from a building associated with the security device 10. Additionally, the security device 10 may include a battery 43 electrically coupled to at least one of the power cord 41, the light 20, the camera 22, the at least one directional microphone 55, and/or any other electrical component described in this disclosure. The battery 43 may be configured to provide power to at least one of the light 20, the camera 22, the at least one directional microphone 55, and/or any other electrical component described in this disclosure. In some embodiments, the battery may be configured to be recharged via power received from the power cord 41. In some embodiments, the battery 43 comprises one or more lithium ion batteries.

Figure 24:
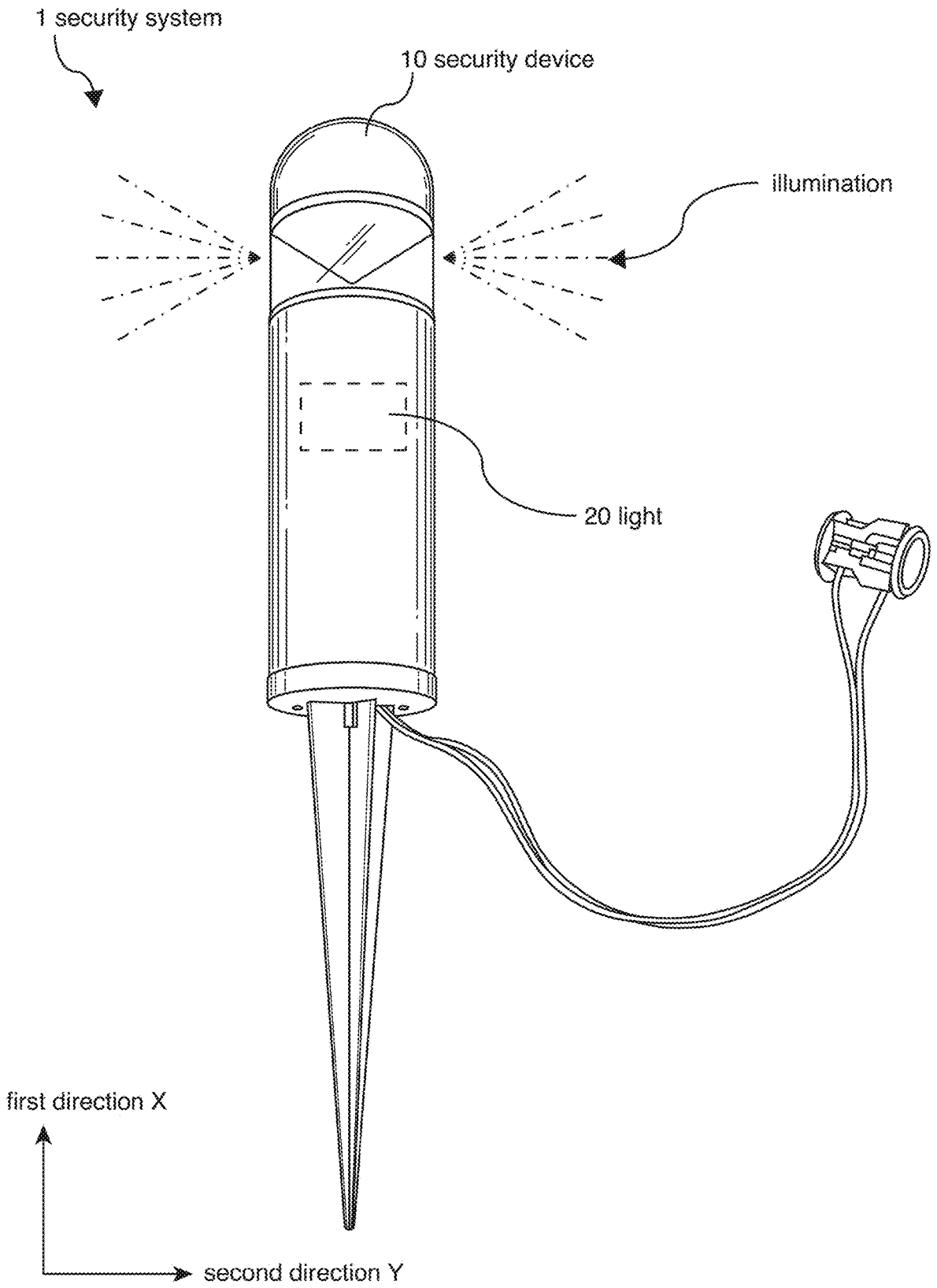
FIG. 24 illustrates a security device being illuminated, according to some embodiments.

As shown in FIG. 24, the security device 10 may also include a light 20 configured to illuminate an area around the outdoor security device 10. The light 20 may be configured to not only illuminate, but also pulse in a strobing pattern. The pulsing may be configured to warn a trespasser that the security system 1 has detected the trespasser's presence. Additionally, the pulsing may be configured to draw the attention of neighbors or emergency personnel to alert them to a situation, of possible danger, at the residence associated with the system 1, such as a person falling into the swimming pool. In order to accomplish the various objectives stated herein, the strobing pattern may comprise a plurality of colors, whereby each color is intended to indicate different situations. Even still, the strobing pattern may comprise a plurality of constant or varied pulse rates.

Figure 25:
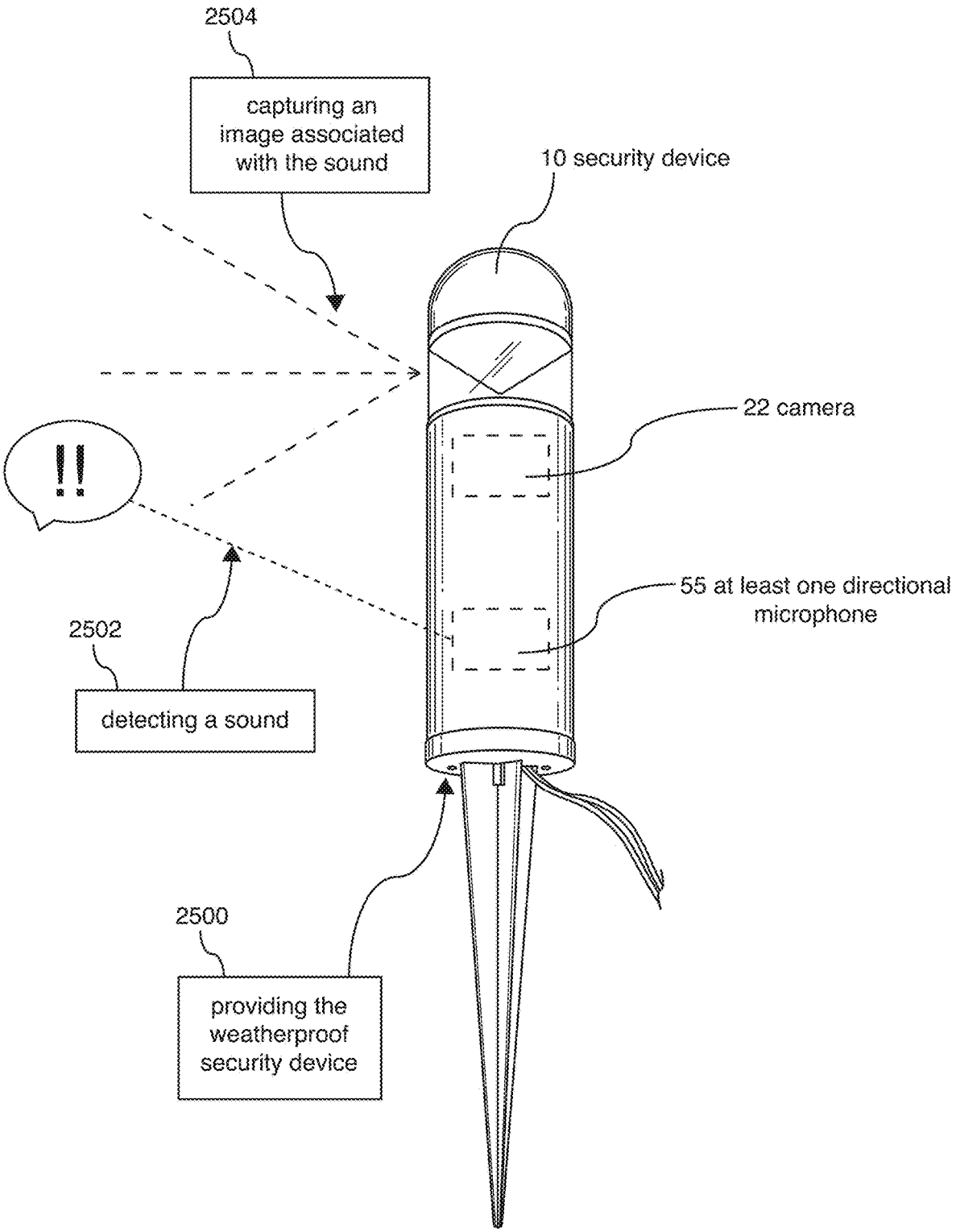
FIGS. 25, 26, 27, 28, and 29 illustrate methods of using various security devices, according to some embodiments.
Figure 26:
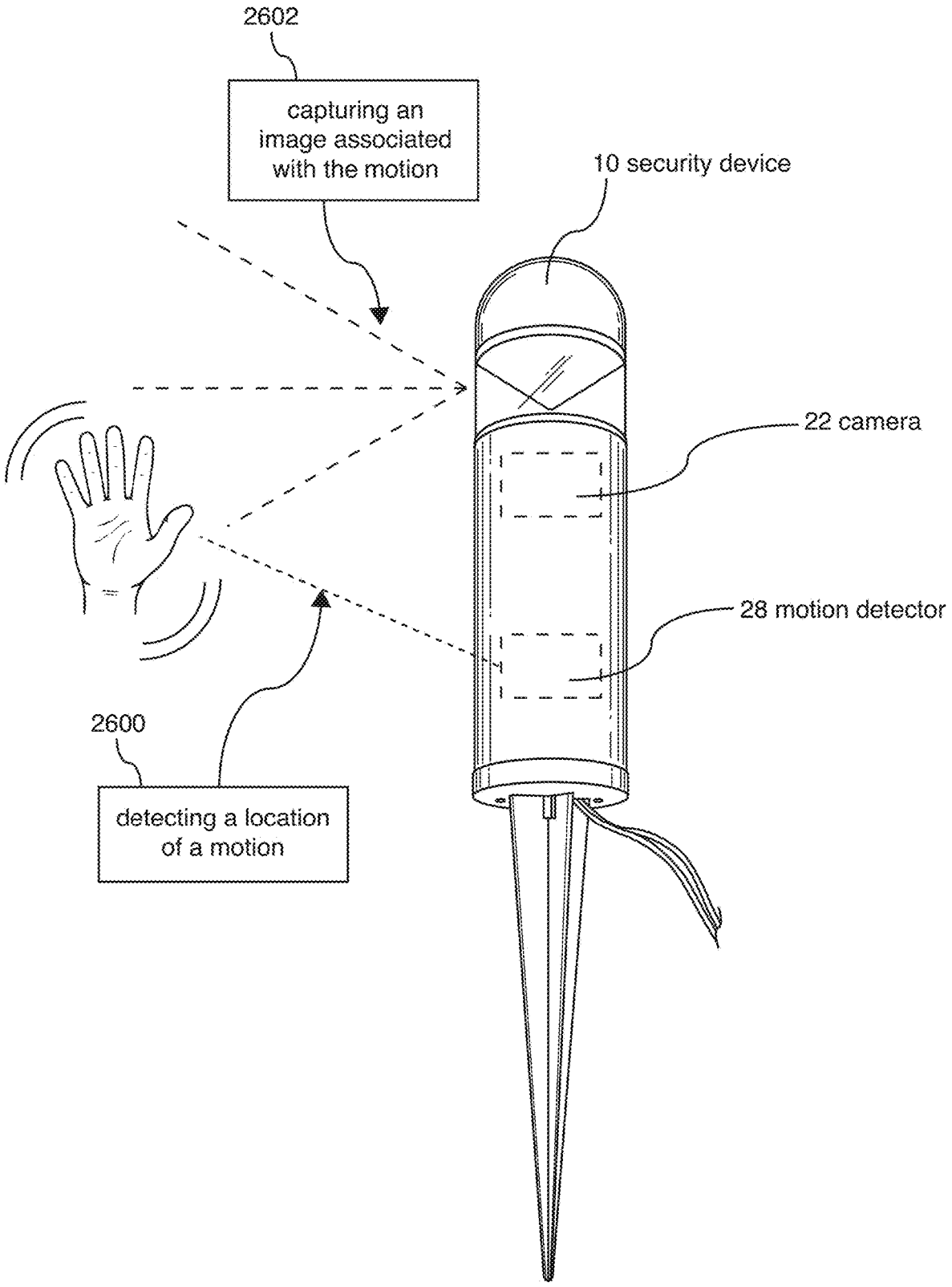

According to FIG. 25, the disclosure also includes a method of using a security system 1. Methods may include providing the weatherproof security device 10 (at step 2500), as described above. Additionally, some methods include detecting a sound via the at least one directional microphone 55 (at step 2502). In response to the detecting (step 2502), methods may include capturing, via the camera 22, an image associated with the sound (at step 2504). In some embodiments, the capturing comprises the camera 22 performing a frame lock 70 of the image associated with the detected sound.

Additionally, some methods include detecting, via the motion detector 28, an indication of a motion and/or a location of a motion (at step 2600). In response to the detecting (step 2600), some methods include capturing, via the camera 22, an image associated with the motion.

Figure 27:
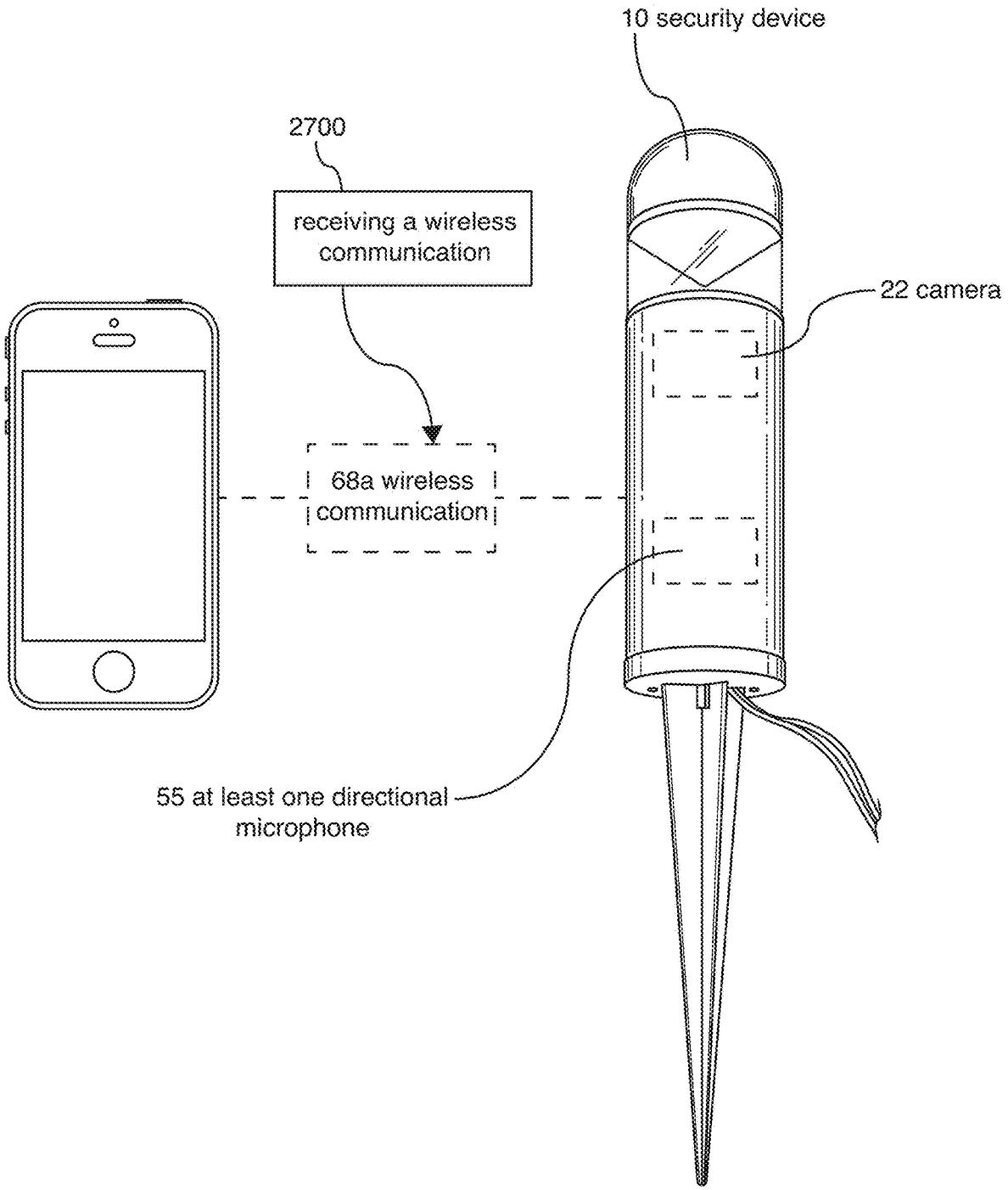
Figure 28:
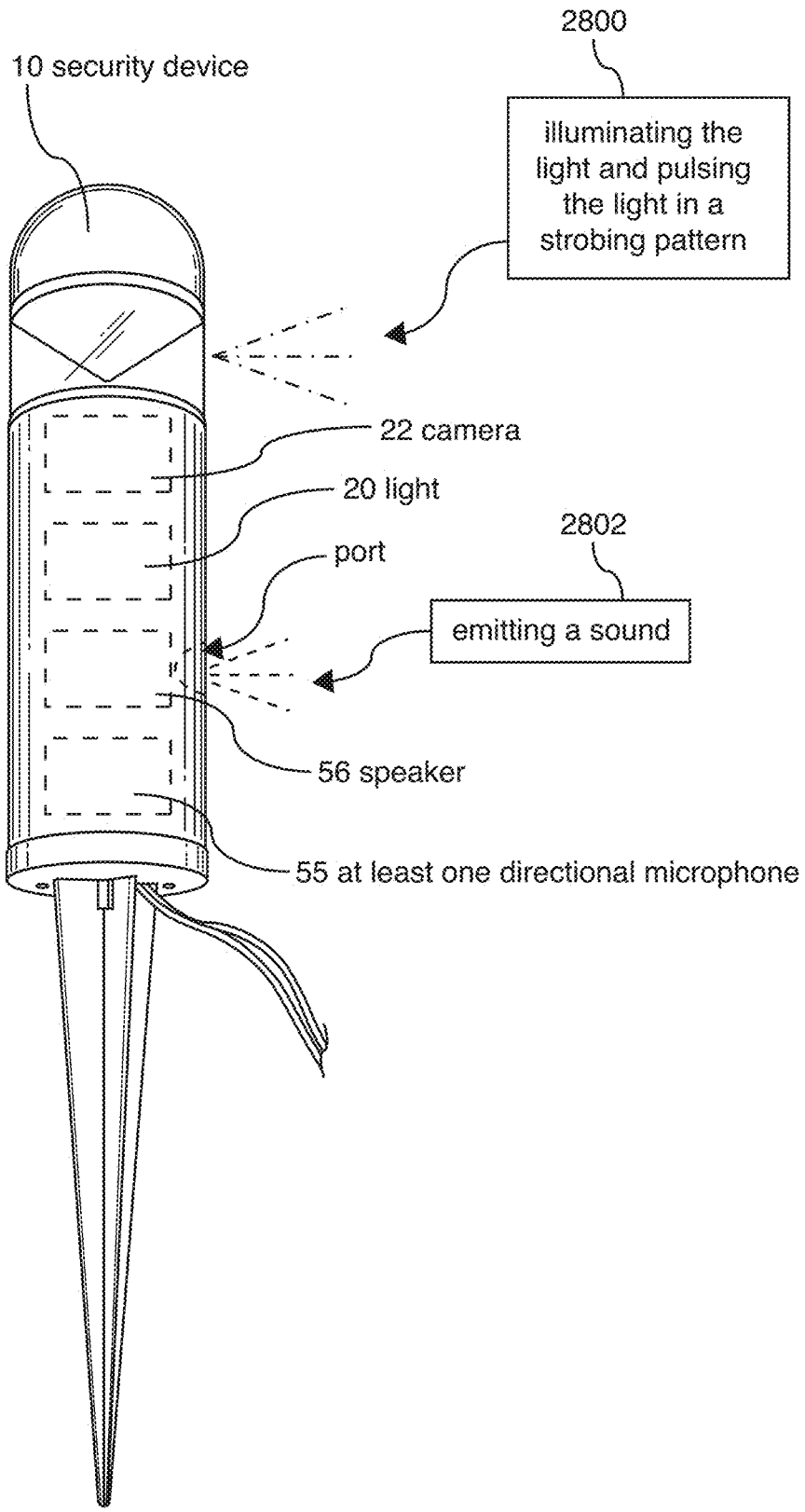

As shown in FIG. 27, in response to the detecting (steps 2502 and/or 2600), some methods include receiving, via a remote computing device 30, an alert (at step 2700). The alert may comprise an image associated with the sound or motion. In some embodiments, the alert comprises the image frame lock 70. Now with reference to FIG. 28, in response to the detecting, some methods include illuminating the light 20 and/or pulsing the light in a strobing pattern (at step 2800). Illuminating the light 20 and/or pulsing the light in a strobing pattern could be performed in response detecting the sound, receiving a wireless communication from the remote computing device 30, detecting an emergency event, and the like. Furthermore, in response to the detecting, some methods include emitting a sound from a speaker 56 (at step 2802).

Figure 29:
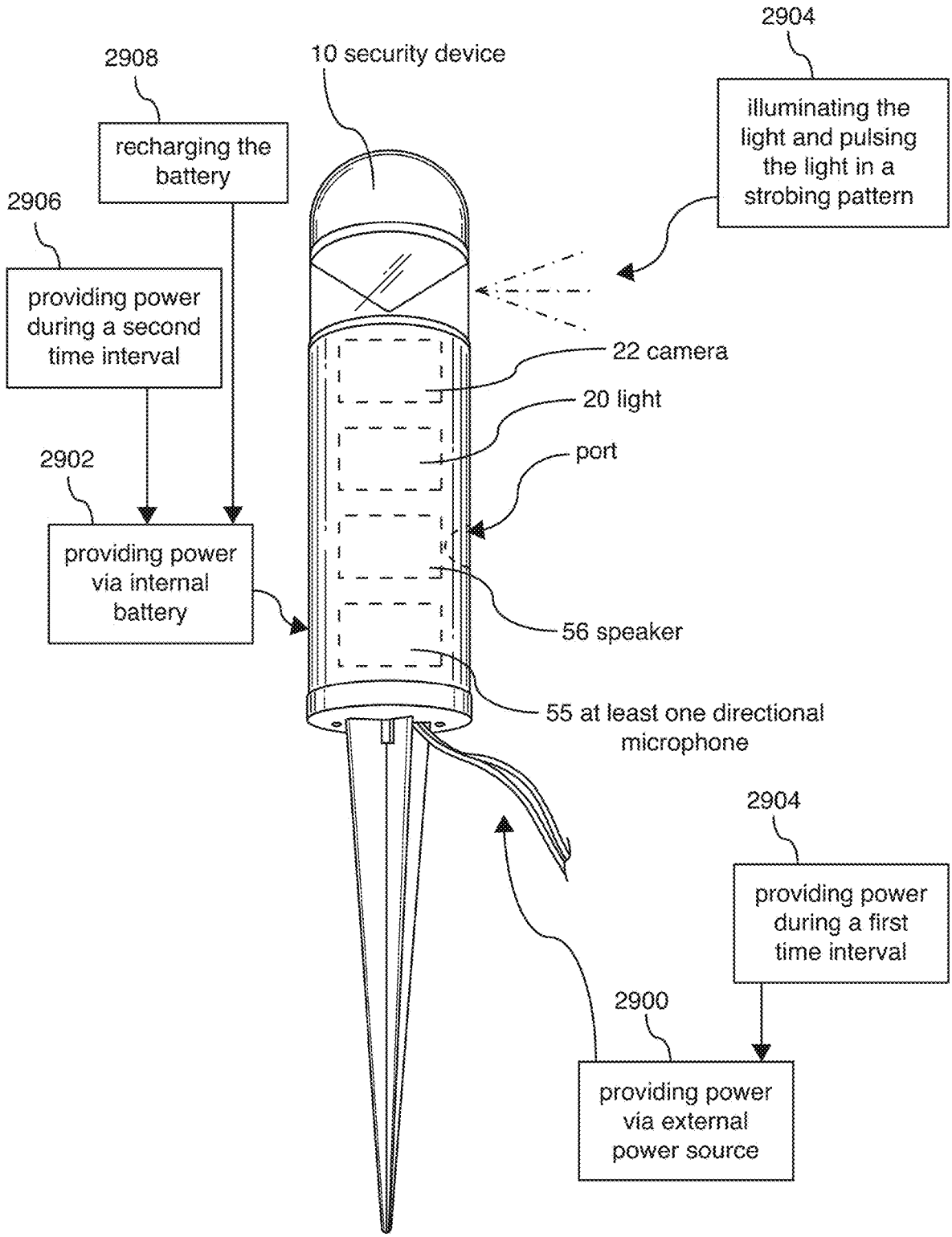

As shown in FIG. 29, some methods include providing power to at least one of the battery 43, the light 20, the camera 22, and the at least one directional microphone 55 via the power cord 41 and/or external power source 45 (at step 2900). Additionally, some methods include providing power to at least one of the light 20, the camera 22, and the at least one directional microphone 55 via the battery 43 (at step 2902). Furthermore, methods may include providing power to at least one of the battery 43, the light 20, the camera 22, and the at least one directional microphone 55 via the power cord 41 and/or external power source 45 during a first time interval (at step 2904). Also, methods may include providing power to at least one of the light 20, the camera 22, and the at least one directional microphone 55 via the battery 43 during a second time interval (at step 2906). For example, the external power source may provide power to the security device from noon to midnight (first time interval), and the battery 43 may provide power to the security device 10 from midnight to noon (second time interval). Methods may also include recharging the battery 43 via the power cord 41 and the external power source 45 during at least one of the first time interval and the second time interval (at step 2908). In some embodiments, recharging the battery only occurs during the first time interval (i.e., when the security device 10 is receiving power from the external power source 45).

Interpretation

The term "about" is used to mean "approximately". For example, the disclosure includes "the field of view is about 220-degrees." In this context, "about" indicates that the field of view may be + or −5 degrees. As such, the statement above should be interpreted to mean the field of view is 215-degrees to 225-degrees.

The term "substantially" is used to mean "completely" or "nearly completely". For example, the disclosure includes "the substantially clear portion". In this context, the term "substantially" indicates that the clear portion is generally transparent.

The disclosure refers to various components being "coupled" to other components. It should be appreciated that any of these couplings may be direct or indirect. For example, if the specification recites that the light is coupled to the housing, this should be interpreted to mean that the light is directly or indirectly coupled to the housing.

It should be appreciated that the term "security" may be used interchangeably with the term "surveillance."

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

Some of the devices, systems, embodiments, and processes use computers. Each of the routines, processes, methods, and algorithms described in the preceding sections may be embodied in, and fully or partially automated by, code modules executed by one or more computers, computer processors, or machines configured to execute computer instructions. The code modules may be stored on any type of non-transitory computer-readable storage medium or tangible computer storage device, such as hard drives, solid state memory, flash memory, optical disc, and/or the like. The processes and algorithms may be implemented partially or wholly in application-specific circuitry. The results of the disclosed processes and process steps may be stored, persistently or otherwise, in any type of non-transitory computer storage such as, e.g., volatile or non-volatile storage.

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments include A, B, and C. The term "and/or" is used to avoid unnecessary redundancy.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

What is claimed is:

1. A security system including an outdoor security device comprising:

a housing elongate along a first direction, the housing comprising a top end, a bottom end, and a hollow inner portion;

a light coupled to the housing and located within the hollow inner portion;

a camera and a lens coupled to the housing, the lens located between the camera and the top end such that the camera is configured to capture images around a perimeter of the outdoor security device;

a visual adjustment device coupled to the top end of the housing, wherein the visual adjustment device is aligned with the lens and the camera such that the visual adjustment device is configured to allow the camera to capture images around the perimeter of the outdoor security device; and one or more microphones communicatively coupled to the camera, wherein each one of the one or more microphones comprises a directional microphone configured to determine a location of a detected sound whereby the camera performs a frame lock to capture an image associated with the detected sound.

2. The security system of claim 1, wherein each one of the one or more microphones comprises a first port and a second port configured to determine the location of the detected sound whereby the camera performs the frame lock to capture the image associated with the detected sound.

3. The security system of claim 1, wherein the one or more microphones comprises a first directional microphone and a second directional microphone each communicatively coupled to the camera, the first directional microphone and the second directional microphone located on opposite sides of the housing and configured to determine the location of the detected sound whereby the camera performs the frame lock to capture the image associated with the detected sound.

4. The security system of claim 1, wherein the visual adjustment device comprises a cone-shaped mirror having a tip facing towards the camera and the lens.

5. The security system of claim 1, wherein the lens comprises a flat lens.

6. The security system of claim 1, wherein the lens comprises a convex lens configured to allow the camera to capture images around the perimeter of the outdoor security device.

7. The security system of claim 1, wherein the camera is configured to capture images 360-degrees around the outdoor security device.

8. The security system of claim 1, wherein the camera is configured to capture images along a vertical field of view that is less than or equal to about 220-degrees.

9. The security system of claim 1, further comprising a substantially clear portion coupled to the housing and located adjacent the top end, wherein the camera is configured to capture images around the perimeter of the outdoor security device through the substantially clear portion.

10. The security system of claim 1, further comprising a power cord electrically coupled to at least one of the light, the camera, and the one or more microphones, wherein the power cord is configured to receive power from an external power source.

11. The security system of claim 10, further comprising a battery electrically coupled to at least one of the power cord, the light, the camera, and the one or more microphones, wherein the battery is configured to be recharged via power received from the power cord, and the battery is configured to thereby provide power to at least one of the light, the camera, and the one or more microphones.

12. The security system of claim 1, further comprising a remote server communicatively coupled to at least one of the light, the camera, and the one or more microphones.

13. The security system of claim 12, further comprising a remote computing device communicatively coupled to least one of the light, the camera, the one or more microphones, and the remote server, wherein the remote computing device is configured to receive an alert in response to the one or more microphones receiving the detected sound.

14. The security system of claim 1, wherein the light is configured to illuminate an area around the outdoor security device.

15. The security system of claim 1, wherein the light is configured to illuminate and pulse in a strobing pattern.

16. The security system of claim 15, wherein the strobing pattern comprises a plurality of colors.

17. The security system of claim 15, wherein the strobing pattern comprises a plurality of pulse rates.

18. The security system of claim 1, further comprising a speaker coupled to the housing and communicatively coupled to at least one of the light, the camera, and the one or more microphones.

19. The security system of claim 1, further comprising:

a wireless communication module coupled to the housing, wherein the wireless communication module comprises at least one of a Wi-Fi extender, Wi-Fi booster, and Wi-Fi repeater; and an antenna coupled to the housing and communicatively coupled to the wireless communication module.

20. The security system of claim 1, further comprising a base removably coupled to the bottom end of the housing.

21. The security system of claim 20, wherein the base includes a stake extending away from the bottom end of the housing.

22. A method of using a security system including an outdoor security device comprising:

providing the outdoor security device comprising, a housing, a light located within a hollow inner portion of the housing, a camera and a lens coupled to the housing whereby the lens is located between the camera and a top end of the housing, one or more microphones communicatively coupled to the camera, and a visual adjustment device coupled to the top end of the housing, wherein the visual adjustment device is aligned with the lens and the camera such that the visual adjustment device is configured to allow the camera to capture images around a perimeter of the outdoor security device, and wherein each one of the one or more microphones comprises a directional microphone configured to determine a location of a detected sound;

detecting a sound via the one or more microphones; and in response to the detecting, capturing, via the camera, an image associated with the sound and performing a frame lock of the image associated with the detected sound.

23. The method of claim 22, wherein the detecting comprises detecting the sound along a radial field of view that is 360-degrees around the outdoor security device and a vertical field of view up to 220-degrees from the outdoor security device.

24. The method of claim 22, further comprising:

providing power to at least one of a battery, the light, the camera, and the one or more microphones via a power cord electrically coupled to an external power source;

providing power to at least one of the light, the camera, and the one or more microphones via the battery electrically coupled to the housing;

providing power to at least one of the light, the camera, and the one or more microphones via the power cord during a first time interval;

providing power to at least one of the light, the camera, and the one or more microphones via the battery during a second time interval; and recharging the battery via the power cord and the external power source during at least one of the first time interval and the second time interval.

25. The method of claim 22, further comprising in response to the detecting, receiving, via a remote computing device, an alert.

26. The method of claim 22, further comprising in response to the detecting, illuminating the light and pulsing the light in a strobing pattern.

27. The method of claim 22, further comprising in response to the detecting, emitting a sound from a speaker coupled to the housing and communicatively coupled to at least one of the light, the camera, and the one or more microphones.

* * * * *